US007571690B2

(12) United States Patent
Ogawa et al.

(10) Patent No.: US 7,571,690 B2
(45) Date of Patent: Aug. 11, 2009

(54) PRINTABLE EMBROIDERY MACHINE

(75) Inventors: Masao Ogawa, Nagoya (JP); Hiroshi Kitazawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 153 days.

(21) Appl. No.: 10/594,457

(22) PCT Filed: Jan. 27, 2005

(86) PCT No.: PCT/JP2005/001107

§ 371 (c)(1),
(2), (4) Date: Sep. 26, 2006

(87) PCT Pub. No.: WO2005/093146

PCT Pub. Date: Oct. 6, 2005

(65) Prior Publication Data

US 2007/0204775 A1 Sep. 6, 2007

(30) Foreign Application Priority Data

Mar. 29, 2004 (JP) ..... 2004-096837

(51) Int. Cl.
*D05B 21/00* (2006.01)

(52) U.S. Cl. ..... 112/470.09; 112/102.5; 112/470.06; 112/470.14; 700/138

(58) Field of Classification Search ..... 112/17, 112/102, 102.5, 103, 470.06, 470.09, 470.14; 700/136, 138
See application file for complete search history.

(56) References Cited

U.S. PATENT DOCUMENTS 5,144,899 A * 9/1992 Allen ..... 112/103
5,231,941 A * 8/1993 Wakayama ..... 112/102.5
5,284,104 A * 2/1994 Hori et al. ..... 112/102.5
5,666,894 A * 9/1997 Jonsson et al. ..... 112/103
5,906,168 A * 5/1999 Ito et al. ..... 112/103
6,012,403 A * 1/2000 Codos et al. ..... 112/117
6,035,792 A * 3/2000 Yoshida ..... 112/103
6,158,366 A * 12/2000 Codos ..... 112/117
6,189,989 B1 2/2001 Hirabayashi et al.
6,401,641 B1 * 6/2002 Miyano ..... 112/470.06

(Continued)

FOREIGN PATENT DOCUMENTS

JP A 3-71851 3/1991

(Continued)

*Primary Examiner*—Gary L Welch
*Assistant Examiner*—Nathan E Durham
(74) *Attorney, Agent, or Firm*—Oliff & Berridge, PLC

(57) ABSTRACT

A printable embroidery machine includes a sewing machine body, a cloth holding frame holding a workpiece cloth, a frame drive unit which has a mounting part and to which the cloth holding frame is coupled so that the cloth holding frame is moved independently in two horizontal directions perpendicular to each other, and an ink-jet printer. The body or the printer is detachably attached to the mounting part of the frame drive unit separated from the body so that the workpiece cloth held on the cloth holding frame moved by the frame drive unit is printed by the printer. A predetermined sewing reference position of a sewing needle in attaching the body to the frame drive unit corresponds with a predetermined print reference position of a print head of the printer in a case where the printer is attached to the frame drive unit.

14 Claims, 17 Drawing Sheets

U.S. PATENT DOCUMENTS

| | | | | |
|---|---|---|---|---|
| 6,832,569 | B2 * | 12/2004 | Krasnitz | 112/103 |
| 6,957,614 | B1 * | 10/2005 | Buck | 112/103 |
| 2004/0221783 | A1 * | 11/2004 | Niimi | 112/475.01 |

FOREIGN PATENT DOCUMENTS

| | | |
|---|---|---|
| JP | A 5-272046 | 10/1993 |
| JP | A 6-299458 | 10/1994 |
| JP | A 9-109382 | 4/1997 |
| JP | A 9-256260 | 9/1997 |
| JP | A 9-279469 | 10/1997 |
| JP | A 10-60766 | 3/1998 |
| JP | A 2002-200379 | 7/2002 |
| JP | A 2004-34667 | 2/2004 |

* cited by examiner

PRINTABLE EMBROIDERY MACHINE

TECHNICAL FIELD

This invention relates to a printable embroidery machine in which an ink-jet printer is attached to a frame drive unit separated from a machine body of the embroidery machine and which is constructed so as to be capable of printing workpiece cloth held on a cloth holder which is moved by the frame drive unit.

BACKGROUND ART

Embroidery machines conventionally comprise a machine body having a sewing needle capable of sewing workpiece cloth, a needle bar, a needle bar vertically driving mechanism and a thread take-up mechanism, a cloth holding frame holding workpiece cloth to be sewn in an extended state and a frame drive unit connected to and moving the cloth holding frame independently in two horizontal directions perpendicular to each other. The frame drive unit is attached to a bed of the machine body particularly in household embroidery machines and is detachable from the machine body in many household embroidery machines.

Furthermore, an embroidery machine provided with an ink-jet printer has conventionally been proposed (for example, JP-A-H05-272046 and JP-A-H09-256260). In this construction, a print head of the printer is located in the vicinity of workpiece cloth of the cloth holding frame connected to the frame drive unit, and the cloth holding frame is moved horizontally by the frame drive unit so that the printer injects ink onto the workpiece cloth of the cloth holding frame or an embroidery pattern formed on the workpiece cloth thereby to be capable of printing.

For example, an embroidery machine described in JP-A-H05-272046 is an industrial machine and comprises a horizontally long sewing machine frame provided over a sewing machine table, a plurality of sewing machine heads connected to a front of the sewing machine frame and a plurality of print heads which are connected to a rear of the sewing machine frame so as to be movable up and down. A cloth holding frame is mounted on the sewing machine table so as to be moved horizontally by a frame drive unit. When the embroidery machine is switched between the state where sewing is carried out and the state where printing is carried out, the cloth holding frame is moved (offset) in the cross direction by a distance between a sewing needle and the print head.

Furthermore, an embroidery machine described in JP-A-H09-256260 is an industrial machine and comprises a sewing machine head provided with a needle bar case in which a plurality of needle bars are supported so as to be movable up and down. The needle bar case is moved so that one of the needle bars is switched to a use position. At least one of the needle bars is replaced by a print head in the needle bar case. The print head is provided with a movable head which is moved up and down by a vertically moving mechanism.

DISCLOSURE OF THE INVENTION

Problem to be Overcome by the Invention

The embroidery machine of JP-A-H05-272046 has a structure that the printer is mounted integrally on the sewing machine frame of the sewing machine body. Since a sewing needle and the print head assume quite different positions, the cloth holding frame needs to be moved (offset) in the cross direction by a distance between the sewing needle and the print head when the embroidery machine is switched between the state where sewing is carried out and the state where printing is carried out. Accordingly, a relatively larger amount of offset (a longer distance between the sewing needle and the print head) results in problems including a large-sized frame drive unit, reduction in a position accuracy of a sewing position of an embroidery pattern formed on workpiece cloth and a print position of a print pattern, a large-sized whole embroidery machine with increase in the provision of a printer on the sewing machine body and a large-sized frame drive unit, an increase in the manufacturing cost of the embroidery machine and the like.

Furthermore, since the print head is provided in the needle bar case instead of one needle bar in the embroidery machine of JP-A-H09-256260, the sewing needle and the print head can assume approximately the same position and consequently, the problem of large-sized frame drive unit as in JP-A-H05-272046 can be overcome. On the other hand, however, the drive of the sewing needle during sewing oscillates the needle bar case. The oscillation transmits to the print head such that ink sometimes leaks from the print head. In this case, there results in a problem that leaked ink adheres to the workpiece cloth thereby to soil the cloth. When only the embroidery pattern is desired to be formed on the workpiece cloth, the printer which is not necessitated interferes with the forming of embroidery pattern because of the above problem. An embroidery machine without a printer may be used in this case. However, when the printer is necessary thereafter, it is hard to provide a printer later. It is unreasonable to purchase an embroidery machine provided with a printer. This is also a problem of the embroidery machine of JP-A-H09-256260.

Furthermore, the embroidery machine of JP-A-H05-272046 or JP-A-H09-256260 has the following problem:

Ink-jet printers necessitate maintenance such as flushing, purge and the like in order that injection of ink by the print head may become favorable. In flushing, the print head is periodically moved to an installation position of an ink absorber so that ink is discharged from a nozzle of the print head onto the ink absorber. In purging, the print head is periodically moved to an installation position of a suction mechanism so that bubble-containing ink is sucked from the nozzle thereby to be disposed of.

However, the embroidery machines of JP-A-H05-272046 and JP-A-H09-256260 disclose nothing about the mechanisms of these maintenance procedures and accordingly, it is doubtful whether the machines can be put to practice as printers printing on workpiece cloth. More specifically, the workpiece cloth needs to be kept clean during these maintenance procedures, and an embroidery frame needs to be avoided from interference with the print head or maintenance mechanism when workpiece cloth held on the embroidery frame having a thickness in the vertical direction. JP-A-H05-272046 and JP-A-H09-256260 disclose nothing in these regards. Additionally, when a printer having the above configuration is provided integrally on the sewing machine body, the size of the whole embroidery machine is excessively increased and in particular, the disclosed embroidery machines are not suitable as household sewing machines.

An object of the present invention is to easily and reliably mount either sewing machine body or printer on the frame drive unit in a printable embroidery machine, to be capable of sewing and printing on the workpiece cloth without re-holding on the cloth holding frame, to reduce the size and the manufacturing cost of the frame drive unit so that the embroidery machine becomes suitable for a household sewing machine.

Means for Overcoming the Problem

The present invention provides a printable embroidery machine comprising a sewing machine body that sews a workpiece cloth, a cloth holding frame holding a workpiece cloth to be sewn, a frame drive unit which has a mounting part and to which the cloth holding frame is coupled so that the cloth holding frame is moved independently in two horizontal directions perpendicular to each other, and an ink-jet printer, wherein the sewing machine body or the ink-jet printer is detachably attached to the mounting part of the frame drive unit separated from the sewing machine body so that the workpiece cloth held on the cloth holding frame moved by the frame drive unit is printed by the printer, whereby the mounting part is common to the sewing machine body or the ink-jet printer, and a predetermined sewing reference position of a sewing needle in attaching the sewing machine body to the frame drive unit corresponds with a predetermined print reference position of a print head of the printer in a case where the printer is attached to the frame drive unit.

In the above-described construction, the frame drive unit has the mounting part which is detachably attached to the sewing machine body. The ink-jet printer is detachably attached to the mounting part of the frame drive unit separated from the sewing machine body. The printer is capable of printing the workpiece cloth moved by the cloth holding frame. Accordingly, either sewing machine body or printer can be attached to the frame drive unit reliably, whereby the workpiece cloth can be both sewn and printed without the re-holding of the workpiece cloth on the cloth holding frame. Moreover, the position of the sewing needle in the case where the sewing machine body has been attached to the frame drive unit corresponds approximately with the position of the print head in the case where the printer has been attached to the frame drive unit and accordingly, the workpiece cloth can be sewn and printed without offset of the cloth holding frame. Consequently, the size and the manufacturing cost of the frame drive unit can be reduced. Furthermore, the positional accuracies of the embroidery pattern formed on the workpiece cloth and the printed pattern can be improved.

BEST MODE FOR CARRYING OUT THE INVENTION

The invention will be described in more detail with reference to the accompanying drawing.

A first embodiment of the present invention will be described with reference to FIGS. 1 to 7.

Figure 1:
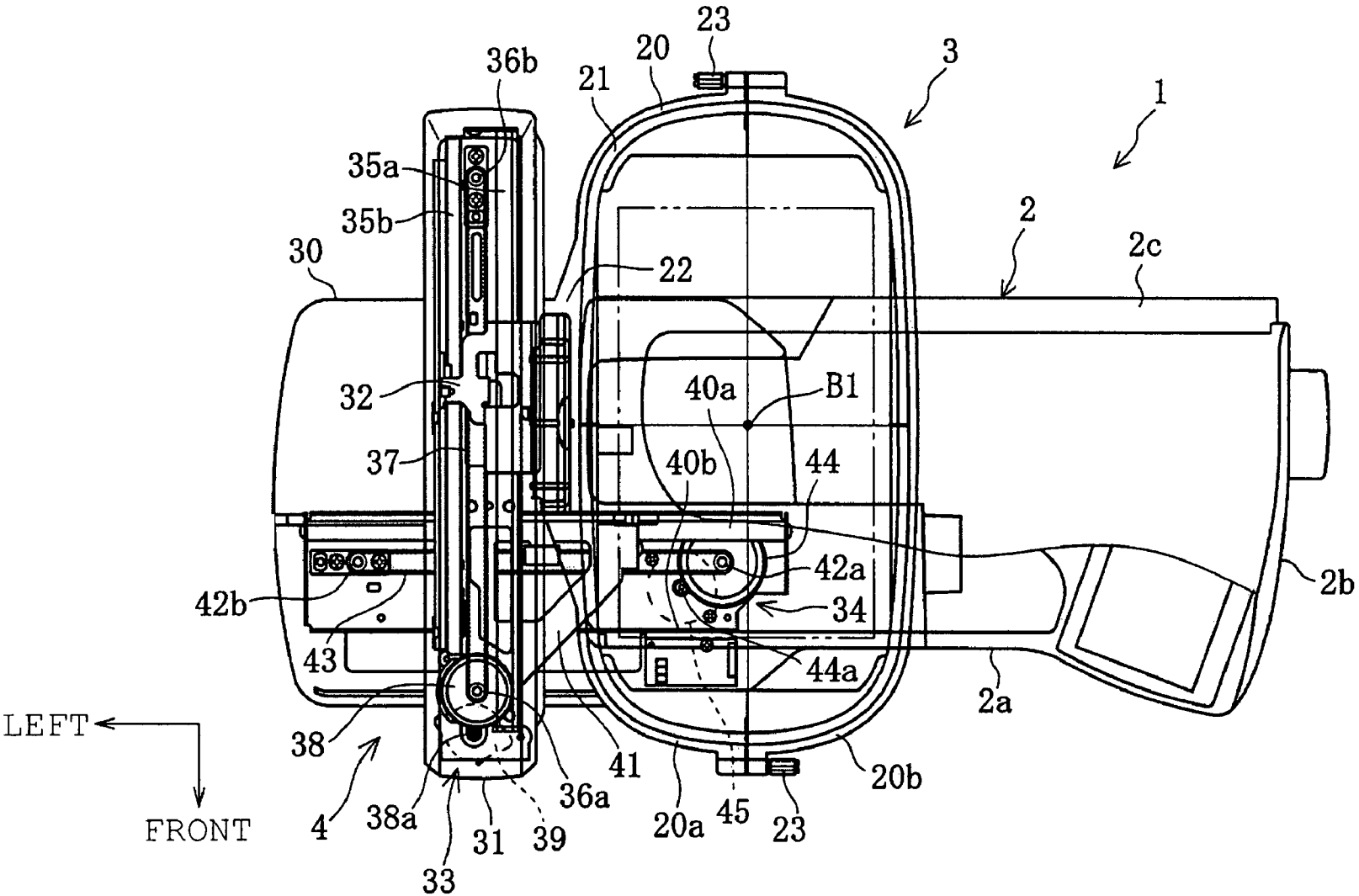
FIG. 1 is a plan view of an embroidery machine (a sewing machine body, a frame drive unit) of a first embodiment in accordance with the present invention.
Figure 2:
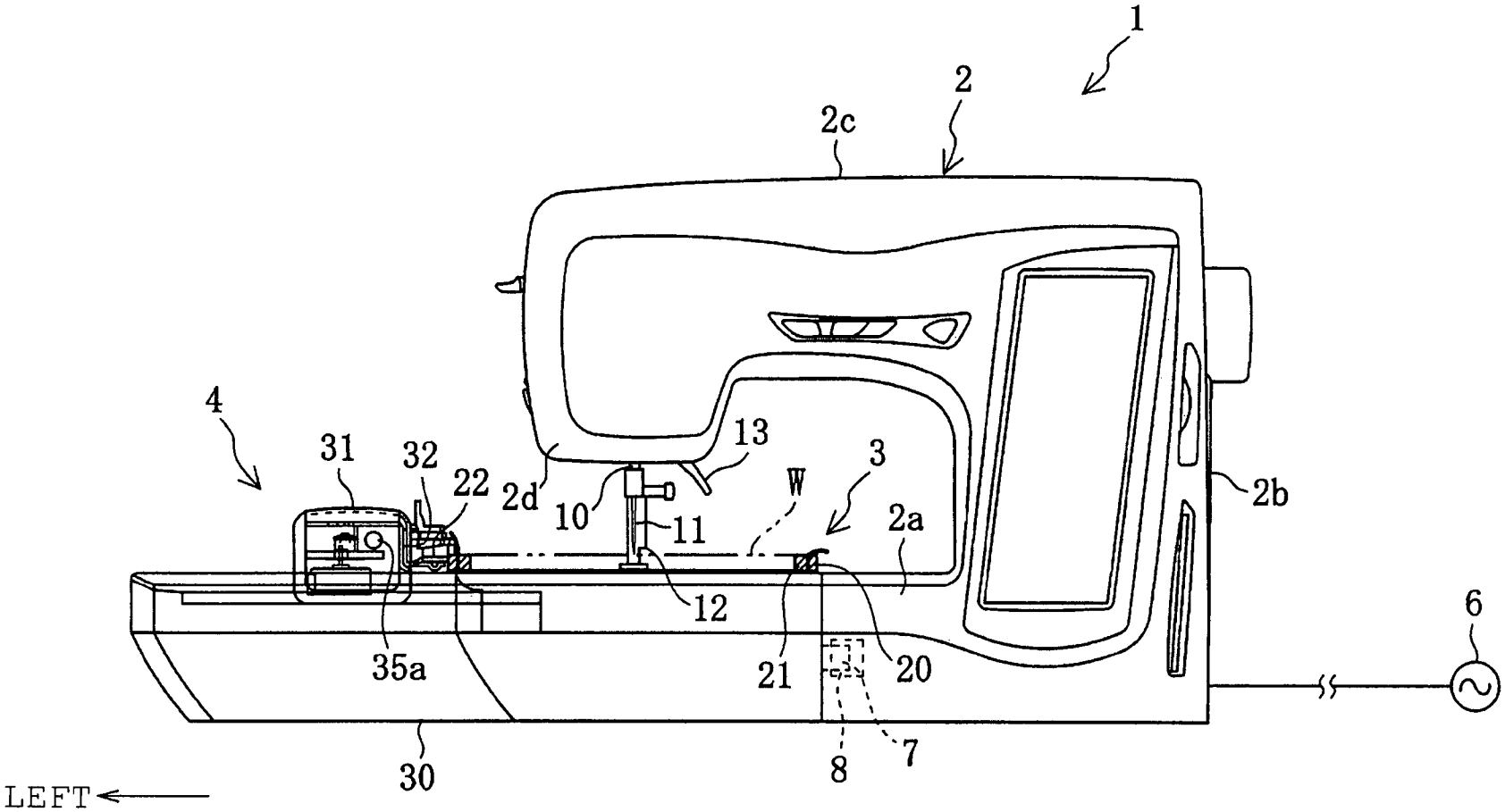
FIG. 2 is a front view of the embroidery machine as shown in FIG. 1.

A printable embroidery machine 1 comprises a sewing machine body 2 capable of sewing workpiece cloth W, a cloth holding frame 3 holding the workpiece cloth W to be sewn and a frame drive unit 4 which has a mounting part 4*a* (see FIG. 3) detachably attached to the sewing machine body 2 and is coupled to the cloth holding frame 3 to move the cloth holding frame 3 independently both in cross and horizontal directions (in two horizontal directions perpendicular to each other), as shown in FIGS. 1 and 2.

An ink-jet printer 5 is detachably attached to the mounting part 4*a* of the frame drive unit 4 separated from the sewing machine body 2 so that the workpiece cloth W held on the cloth holding frame 3 moved by the frame drive unit 4 can be printed by the printer 5, as shown in FIGS. 3 to 8.

Firstly, the sewing machine body 2 will be described. The sewing machine body 2 has a bed 2*a*, a pillar 2*b* standing from the right part of the bed 2*a*, an arm 2*c* extending leftward from an upper part of the pillar 2*b* in opposite relation with the bed 2*a* and a head 2*d* provided on a left part of the arm 2*c*, as shown in FIGS. 1 and 2. A needle bar 10 is supported on the head 2*d* so as to be moved upward or downward. The needle bar 10 has a lower end to which a sewing needle 11 is attached. Furthermore, on the head 2*d* are provided a cloth presser 12 and a presser operating lever 13 operated so that the cloth presser 12 is moved upward or downward.

Furthermore, the sewing machine body 2 is provided with a control unit 14, various operation switches 15, a main shaft position detecting sensor 16, a sewing machine motor 17 and a drive circuit 17*a* for the sewing machine motor 17. Electric power is supplied from a domestic power supply 6 to the sewing machine body 2. A main shaft (not shown) is rotated by the sewing machine motor 17 so that the needle bar 10 is reciprocated up and down by a needle bar vertically driving mechanism (not shown), whereby stitches are formed on the workpiece cloth W in cooperation of the sewing needle 11 of the needle bar 10 and a thread take-up mechanism (not shown) provided in the bed 2*a*.

Next, the cloth holding frame 3 will be described. The cloth holding frame 3 has an outer frame 20, an inner frame 21 fitted in the outer frame 20 and a coupling part 22 releasably coupled to the frame drive unit 4, as shown in FIGS. 1 to 8. The outer frame 20 includes an outer frame left half 20*a* and an inner frame right half 20*b*. Front and rear ends of the left and right halves 20*a* and 20*b* are coupled to each other by a pair of screws 23. The coupling part 22 is formed integrally with the outer frame left half 20*a*. When held by the cloth holding frame 3, the workpiece cloth W is usually placed and set on the outer frame 20 while the inner frame 21 is removed from the outer frame 20. The inner frame 21 is fitted into the outer frame 20 from above so that the workpiece cloth W is held between the outer and inner frames 20 and 21. When the inner frame 21 is completely fitted in the outer frame 22, the paired screws 23 are tightened up while the workpiece cloth W is stretched, thereby finishing the holding of the workpiece cloth W on the cloth holding frame 3.

Next, the frame drive unit 4 will be described. The frame drive unit 4 comprises a generally C-shaped body case 30, a crosswise elongated movable case 31 which is provided on the body case 30 so as to be movable horizontally, a carriage 32 which is attached to the movable case 31 so as to be movable in the cross direction, a crosswise drive mechanism 33 driving the carriage 32 in the cross direction and a horizontal drive mechanism 34 driving the carriage 32 in the horizontal direction together with the body case 30. The body case 30 is formed with an attached part 4*a* detachably attached to the bed 2*a* of the sewing machine body 2. The coupling part 22 of the cloth holding frame 3 is releasably coupled to the carriage 32.

Two crosswise long guide members 35*a* and 35*b* are provided in the movable case 31. The carriage 32 is supported by the guide members 35*a* and 35*b*. The crosswise drive mechanism 33 has a pair of pinions 36*a* and 36*b*, an endless belt 37 extending between the pinions 36*a* and 36*b* and coupled to the carriage 32, a gear 38 coaxially fixed to the pinion 36*a* and a frame driving motor 39 rotating a driving gear 38*a* which is in mesh engagement with the gear 38.

Two horizontally long guide members 40*a* and 40*b* are provided in the body case 30. A movable member 41 is supported by the guide members 40*a* and 40*b*. The movable member 41 is coupled to the movable case 31. The horizontal drive mechanism 34 has a pair of pinions 42*a* and 42*b*, an endless belt 43 extending between the pinions 42*a* and 42*b* and coupled to the movable member 41, a gear 44 coaxially fixed on the pinion 42*a* and a frame driving motor 45 rotating a driving gear 44*a* which is in mesh engagement with the gear 44.

Figure 9:
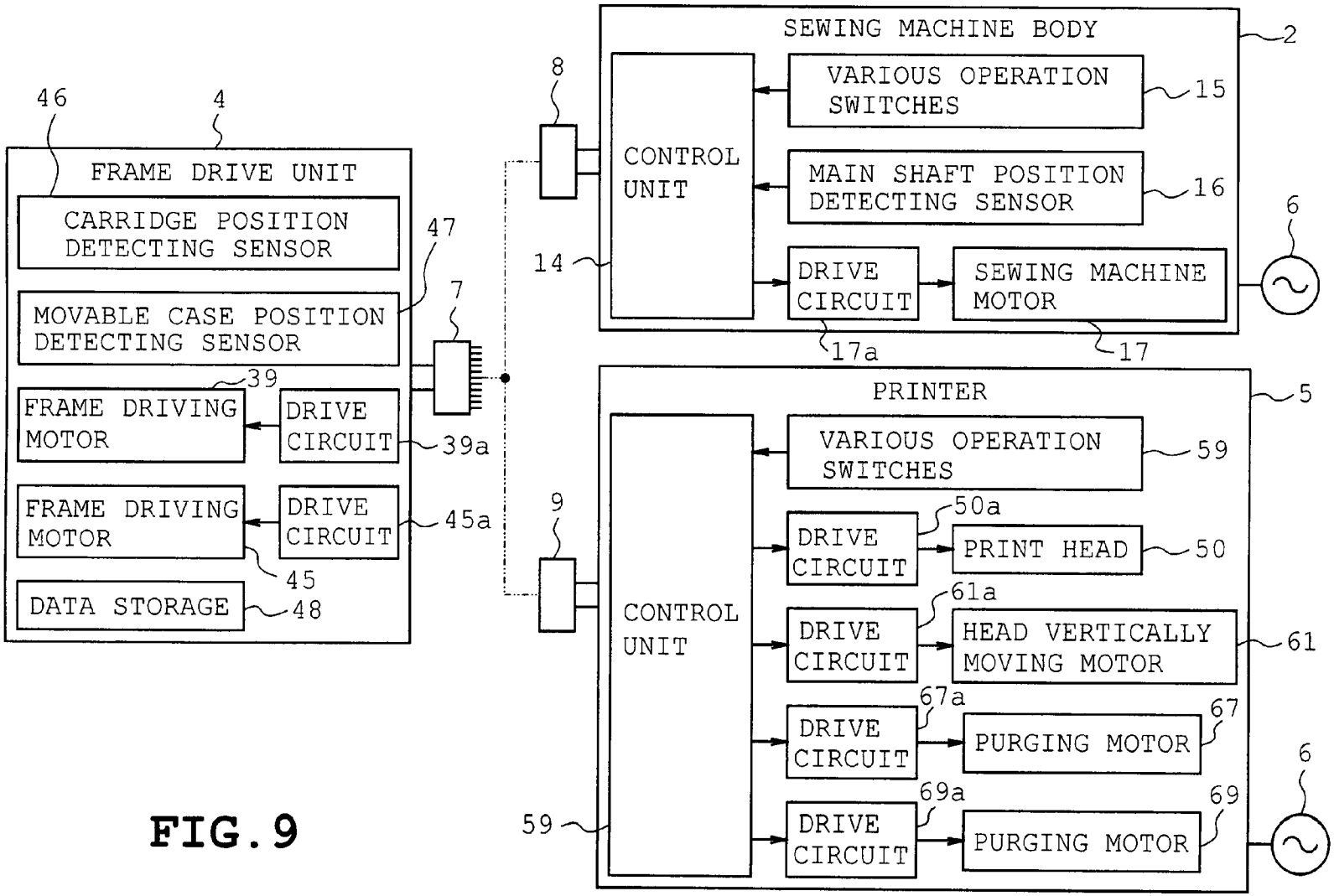
FIG. 9 is a block diagram of a control system of the frame drive unit, sewing machine body and printer.

Furthermore, as shown in FIG. 9, the frame drive unit 4 is provided with a carriage position detecting sensor 46, a movable case position detecting sensor 47, drive circuits 39*a* and 45*a* for the frame driving motors 39*a* and 45 respectively and a data storage 48. The data storage 48 is a storage medium for temporarily storing data of embroidery pattern sewn with the swing machine body 2 attached to the frame drive unit 4 and data of printed pattern printed with the printer 5 attached to the frame drive unit 4. The stored data can effectively be used when an embroidery pattern and a printed pattern are formed on the same part of the workpiece cloth W so as to correspond to each other. However, the data storage 48 may be eliminated.

A frame drive unit side connector 7 and a sewing machine body side connector 8 are provided for connecting an electrical system of the frame drive unit 4 and an electric system of the sewing machine body 2 to each other. The connectors 7 and 8 are automatically connected and disconnected when the sewing machine body 2 is attached to and detached from the frame drive unit 4. When the connectors 7 and 8 are connected, the control unit 14 of the sewing machine body 2 is connected to the sensors 46 and 47 of the frame drive unit 4, the drive circuits 39*a* and 45*a* and the data storage 48, whereby electric power is supplied from the domestic power supply 6 through the sewing machine body 2 to the frame drive unit 4 so that the frame driving motors 39 and 45 are controlled by the control unit 14.

Next, the printer 5 will be described. The printer 5 has a bed 5*a*, a bed connecting part 5*b* continuous to the right side of the bed 5*a*, a pillar 5*c* standing from a right part of the bed connecting part 5*b*, an arm 5*d* extending leftward from an upper part of the pillar 5*c* so as to be opposite to the bed connecting part 5*b* and a head 5*e* provided on a left part of the arm 5*d*. The mounting part 4*a* of the frame drive unit 4 is detachably attached to the bed 5*a*. The bed 5*a* has a convex cloth positioning part 5*f* formed on a central upper surface thereof. The head 5*e* extends forward from the arm 5*d*, thus having a larger lengthwise dimension.

The printer 5 has a print head 50, a head position switching mechanism 51 switching a position of the print head 50 and a maintenance mechanism carrying out maintenance of the print head 50.

The head position switching mechanism 51 switches the print head 50 between a print position (see FIG. 8) where the print head 50 is close to the workpiece cloth W of the cloth holding frame 3 coupled to the frame drive unit 4 and non-print position (see FIG. 6) which is spaced away upward from the print position.

The maintenance mechanism is provided with a head cap 52 putting a lid on a nozzle of the print head 50, a purging mechanism 53 carrying out a purging operation as will be described later, a nozzle wiper 54 wiping off ink adhered to a nozzle surface during the purging operation, an ink receiver 55 receiving ink in a flushing operation which will be described later and a wasted ink absorbing felt 56 absorbing wasted ink.

The purging operation refers to an operation of periodically sucking bubble-containing ink from all the nozzles by a suction mechanism in order that bubbles in the nozzles of the print head 50 may be eliminated, wasting the sucked ink.

The flushing operation refers to an operation of periodically moving the print head 50 to an installation position of the ink receiver 55 to cause all the nozzles of all the print heads 50 to discharge ink onto the ink absorber in order that the nozzles of the print head may be prevented from being dried.

The foregoing printer is an apparatus which is capable of color printing by injecting, for example, four inks from the print head 50.

In the above-described construction, the head cap 52, nozzle wiper 54 and ink receiver 55 are provided in the purging mechanism 53. These members 52 to 55 are attached to a case, thereby constituting a purge unit 67. The printer 5 is provided with a moving mechanism 58 which moves the purging mechanism 53 (that is, the purge unit 57) in the cross direction relative to the print head 50. The moving mechanism 58 thus moves the purging mechanism 53 as described above so that the purging mechanism can be switched among a purging position (see FIG. 5) where the purging mechanism is purgeable, a printable position (see FIG. 7) which is spaced away forward from the purging position so that the printer 5 is printable and a flushing position (a position between the purging and printable positions) where the ink receiver can receive ink due to flushing.

Furthermore, as shown in FIG. 9, the printer 5 is provided with a control unit 59, various operation switches 59*a*, the print head 50, a head vertically moving motor 62, a purging motor 67, a purge movement motor 69, drive circuits 50*a*, 62*a*, 67*a* and 69*a*. Electric power is supplied from the domestic power supply 6 to the printer 5. The frame drive unit side connector 7 and the printer side connector 9 are provided for connecting the electrical system of the frame drive unit 4 and an electrical system of the printer 5 to each other. The connectors 7 and 9 are automatically connected and disconnected when the printer 5 is attached to and detached from the frame drive unit 4.

When the connectors 7 and 9 are connected, the control unit 59 of the printer 5 is connected to the sensors 46 and 47 of the frame drive unit 4, the drive circuits 39*a* and 45*a* and the data storage 48, electric power is supplied from the domestic power supply 6 through the printer 5 to the frame drive unit 4 so that the frame driving motors 39 and 45 are controlled by the control unit 14. The frame drive unit side connector 7 is configured so as to be connectable either sewing machine body side connector member 8 or printer side connector member 9.

The print head 50 is provided on a rear part of the head 5*e*. The print head 50 is provided with four rows of nozzles corresponding to four colors of black, cyan, yellow and magenta. Each row has, for example, seventy-five downwardly directed nozzles zigzag arranged at 300 dpi. Each nozzle is provided with a piezoelectric ceramic actuator so that when the control unit 59 delivers a printing command to the drive circuit 59*a* of each nozzle, the piezoelectric ceramic actuator is flexed such that ink is pressurized thereby to be injected from the nozzle.

A cartridge mounting part is provided integrally at an upper part of the print head 50. Four ink cartridges can be replaceably attached to the cartridge mounting part to supply four colors of ink corresponding to the respective nozzles.

The head position switching mechanism 51 is provided on a rear part of the head 5*e*. The head position switching mechanism 51 has a pair of front and read longitudinal guide rods 60 (corresponding to guides) guiding the print head 50 vertically and a head vertically driving mechanism 61 which includes a head vertically moving motor 62 driving the print head 50 vertically. The head vertically driving mechanism 61 has a head vertically moving motor 62, a crank member 64 mounted on a frame of the head 5*e* so as to pivot about a horizontal axis and formed with a sector gear brought into mesh engagement with a driving gear 63 of the head vertically moving motor 62 and a link member 65 having one end rotatably coupled to a lever end of the crank member 64 and the other end rotatably coupled to the print head 50.

When moved downward at a maximum by the head vertically driving mechanism 61, the print head 50 assumes the print position. When moved upward at a maximum, the print head 50 assumes the non-print position. When the print head 50 assumes the non-print position, a space capable of accommodating the purge unit 57 is defined below the print head 50 inside the head 5*e*. When the purge unit 57 is accommodated in the space, the purging mechanism 53 assumes the purging position.

The head cap 52 comprises a rubber cap capable of adhering to the print head 50. In this case, the nozzles of the print head 50 are covered by the head cap 52 thereby to be closed when the head cap 52 is moved upward by the purging motor 67 while the print head 50 is assuming the non-print position and the purging mechanism 53 is assuming the purging position. A number of nozzles are covered by the head cap 52 when purging is carried out while printing is not carried out. On the contrary, the print head 50 may be lowered by the head vertically moving motor 62 without upward movement of the head cap 52 so that the nozzles of the print head 50 are covered by the head cap 52.

The purging mechanism 53 has the head cap 52, a suction pump 66 and a purging motor 67 vertically moving the head cap 52 and driving the suction pump 66. When the purging motor 67 is driven while the print head 50 is at the non-print position and the purging mechanism 53 is at the purging position, the head cap 52 is moved upward thereby to cover the nozzles of the print head 50. Successively, the suction pump 66 is driven such that the inner pressure of the head cap 50 become negative, whereupon bubbles and dust are sucked together with a small amount of ink from the nozzles and channels of the print head 50 thereby to be eliminated.

The nozzle wiper 54 is provided so as to be opposed to the printable position relative to head cap 52 of the purging mechanism 53 assuming the purging position (in the rear of the head cap 52) and at the level of the nozzles of the print head assuming the non-print position. The print head 50 is brought into contact with the nozzle wiper thereby to be wiped when the purging mechanism 53 is moved from the purging position to the printable position by the moving mechanism 58 after the print head 50 has been purged by the purging mechanism 53. As a result, ink remaining on the nozzle surfaces of the print head 50 is cleaned by the purging.

The ink receiver 55 is formed into a trough inclined diagonally right down and is located nearer to the purging position side than the nozzle wiper 54 (in the rear of the nozzle wiper 54) when the purging mechanism 53 is located at the printable position. The wasted ink absorbing felt 56 is provided on the arm 5*d*. In this construction, when the purging mechanism 53 is switched to the flushing position by the moving mechanism 58, the ink receiver 55 is located below the print head 50. The wasted ink absorbing felt 56 is located on the right of the ink receiver 55 irrespective of the position of the purging mechanism 53. Ink received by the ink receiver 55 falls down along the ink receiver 55 thereby to be absorbed by the wasted ink absorbing felt 56.

Two upper and lower rails 68 are attached in the head 5*e* so as to extend the whole cross dimension. The purge unit 57 is supported by the guide rails 68 so as to be guided. The purge unit 57 has a cross dimension which is about one half of the cross dimension of the head 5*e*.

The moving mechanism 58 is provided in the head 5*e* and has a purge movement motor 69 driving the purge unit including the purging mechanism 53 and the like in the cross direction. The purge movement motor 69 is fixed to a crosswise central frame of the head 5*e* sideways and has an output shaft to which a pinion 69*b* is secured. The pinion 69*b* is in mesh engagement with a rack 69*c* formed on an upper surface of a right end of the purge unit 57.

Figure 5:
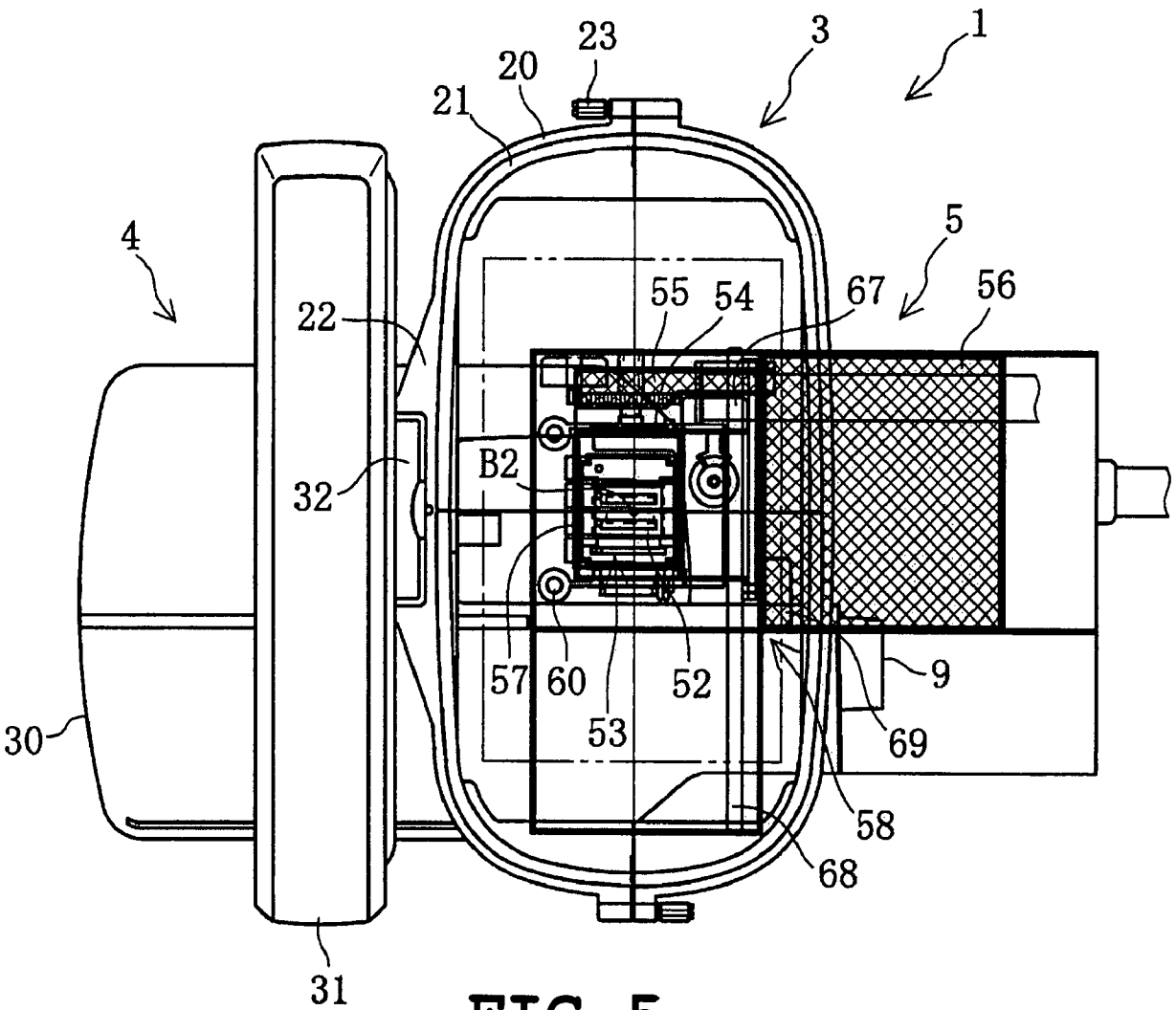
FIG. 5 is a plan view of the frame drive unit and the printer (non-printing state) coupled together.
Figure 7:
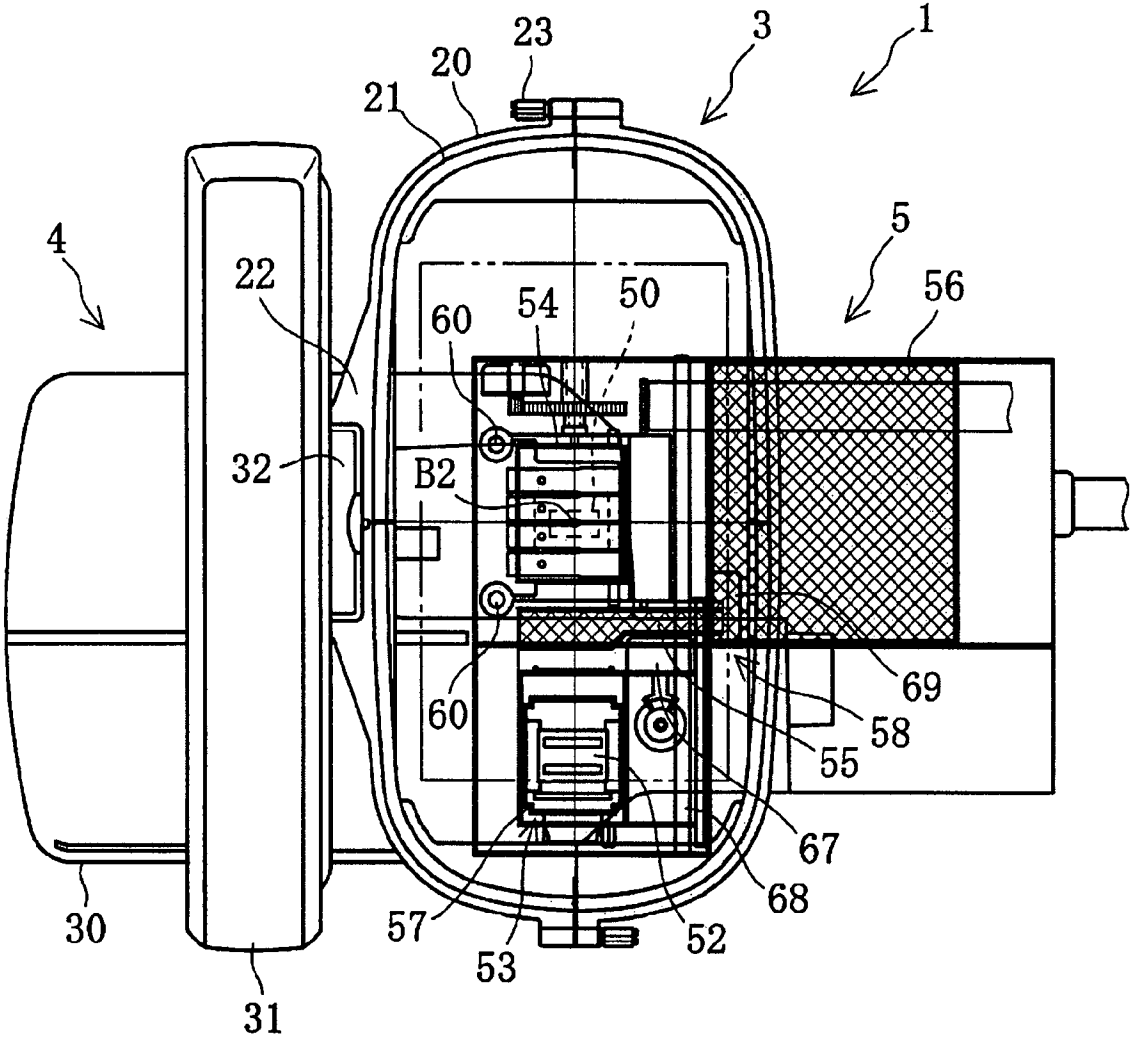
FIG. 7 is a plan view of the frame drive unit and the printer (printable state) coupled together.

The reference symbol B1 designates a predetermined sewing reference position in the case where the sewing machine body 2 is attached to the frame drive unit 4, as shown in FIG. 1. The reference symbol B2 designates a predetermined print reference position in the case where the printer 5 is attached to the frame drive unit 4, as shown in FIGS. 5 and 7. The printable embroidery machine 1 is configured so that the sewing reference position B1 corresponds with the print reference position B2. The sewing reference position B1 is set so that the sewing needle 11 corresponds with the center of a maximum moving region in the case where the cloth holding frame 3 is moved at a maximum. Furthermore, when the printer 5 is attached to the frame drive unit 4, the print reference position B2 is set so that the center of the print head 50 corresponds with the center of the aforesaid maximum moving region. The center of the print head 50 refers to the center of each of a plurality of nozzles of the print head.

The cloth holding frame 3 to be used for the setting of the sewing and print reference positions B1 and B2 should be suitable or estimated to be suitable for embroidery sewing and printing on the workpiece cloth W and has a predetermined shape and size. Regarding the shape and size, the frame center of the cloth holding frame 3 coupled to the carriage 32 corresponds with the sewing needle 11 and the center of the print head 50 in the condition where the movable case 31 is located at the center of a horizontally movable range thereof and the carriage 32 is located at the center of the crosswise movable range.

The operation and effects of the printable embroidery machine 1 will be described. The mounting part 4*a* of the frame drive unit 4 is detachably attached to the bed 2*a* of the sewing machine body 2. The electrical systems of the sewing machine body 2 and frame drive unit 4 as shown in FIG. 9 are connected together by the connectors 7 and 8 while the frame drive unit 4 is attached to the sewing machine body 2, as shown in FIGS. 1 and 2. In this state, the control unit 14 of the sewing machine body 2 controls the frame driving motors 39 and 45 of the frame drive unit 4 based on embroidery data, so that the cloth holding frame 3 coupled to the frame drive unit 4 is moved independently crosswise and horizontally, and the control unit 14 controls the sewing machine motor 17 so that the needle bar 10 is vertically reciprocated to form an embroidery pattern on the workpiece cloth W held on the cloth holding frame 3.

Figure 3:
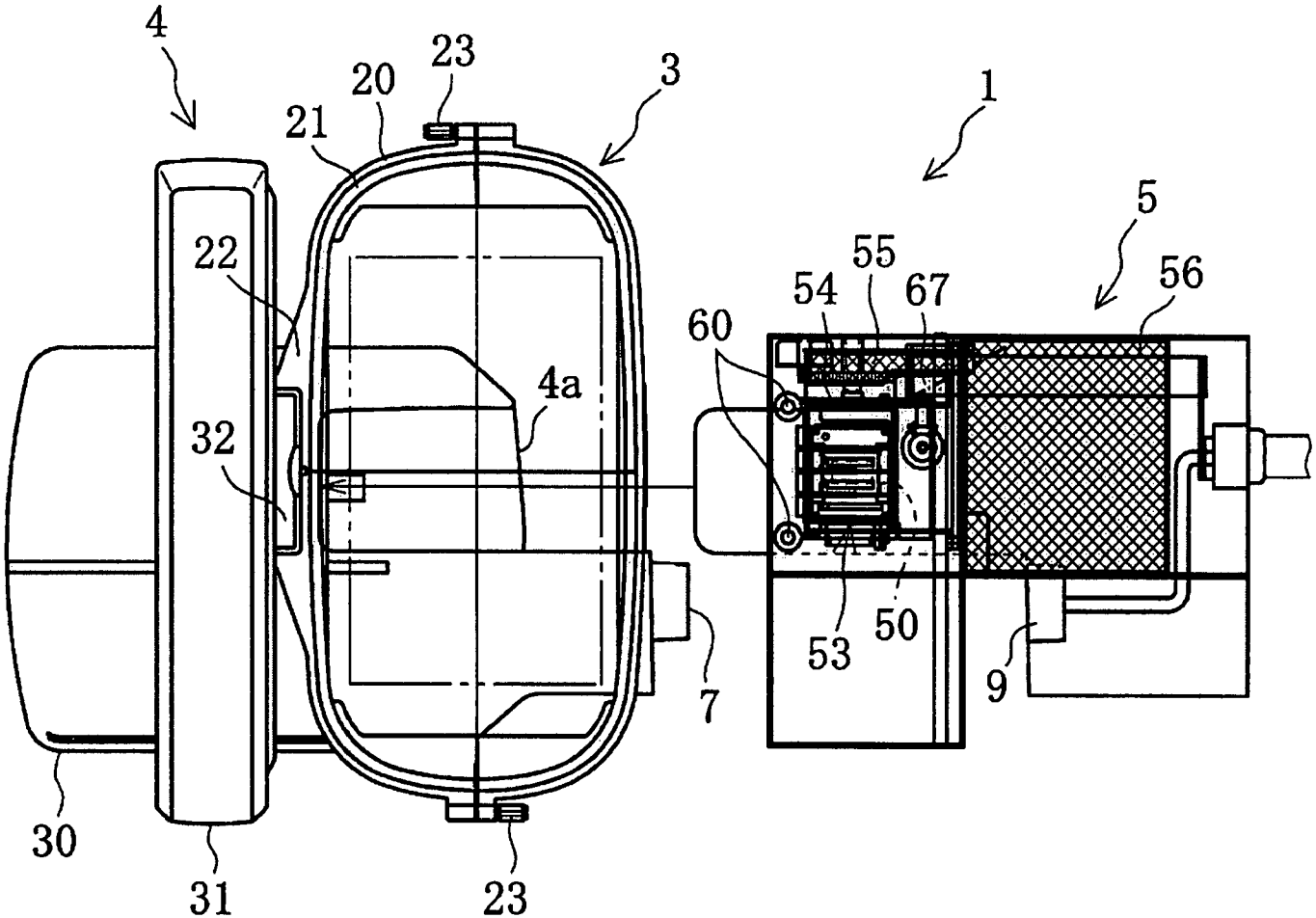
FIG. 3 is a plan view of the frame drive unit and a printer separated from each other.
Figure 4:
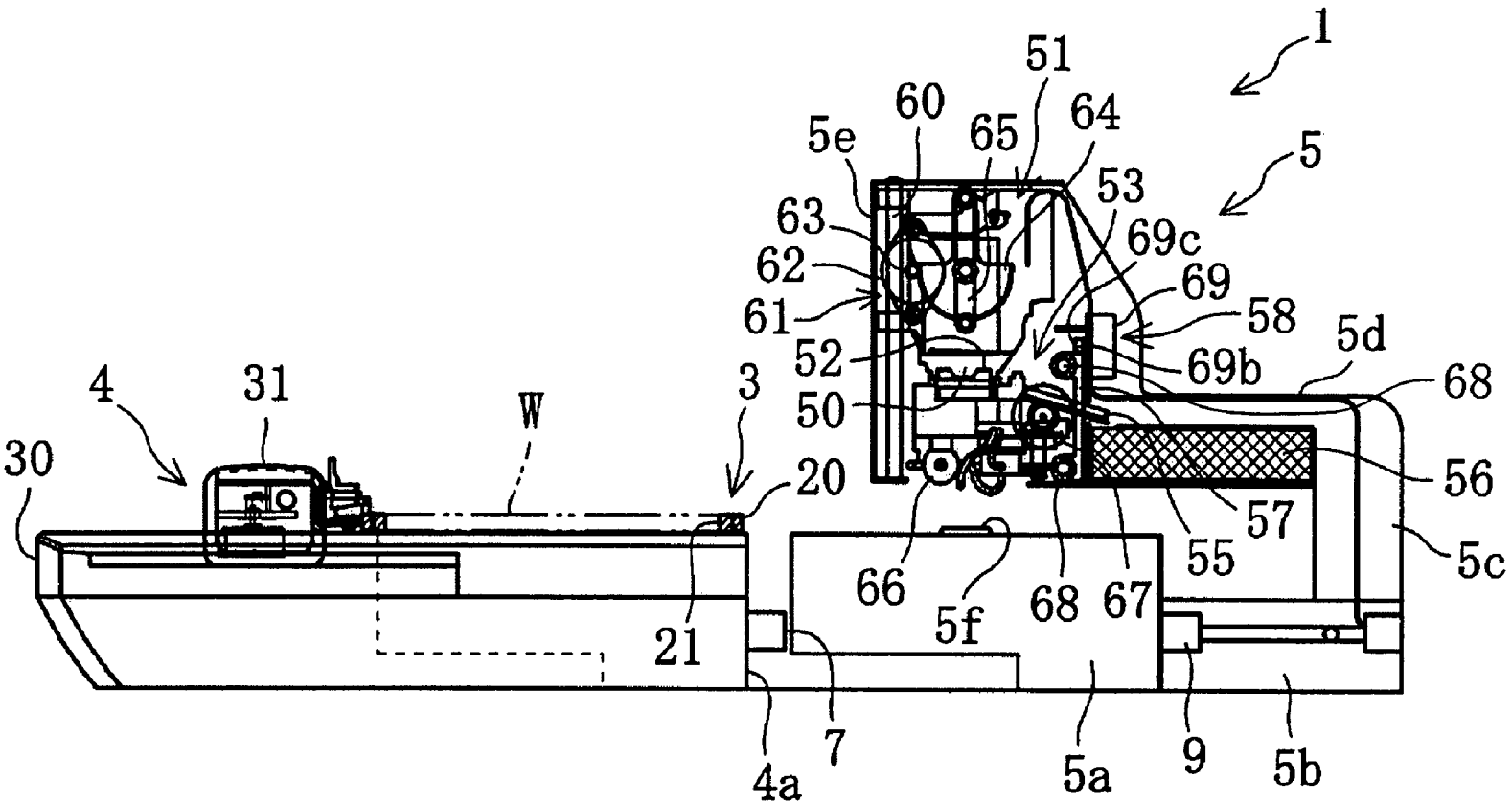
FIG. 4 is a front view of the frame drive unit and the printer as shown in FIG. 3.
Figure 6:
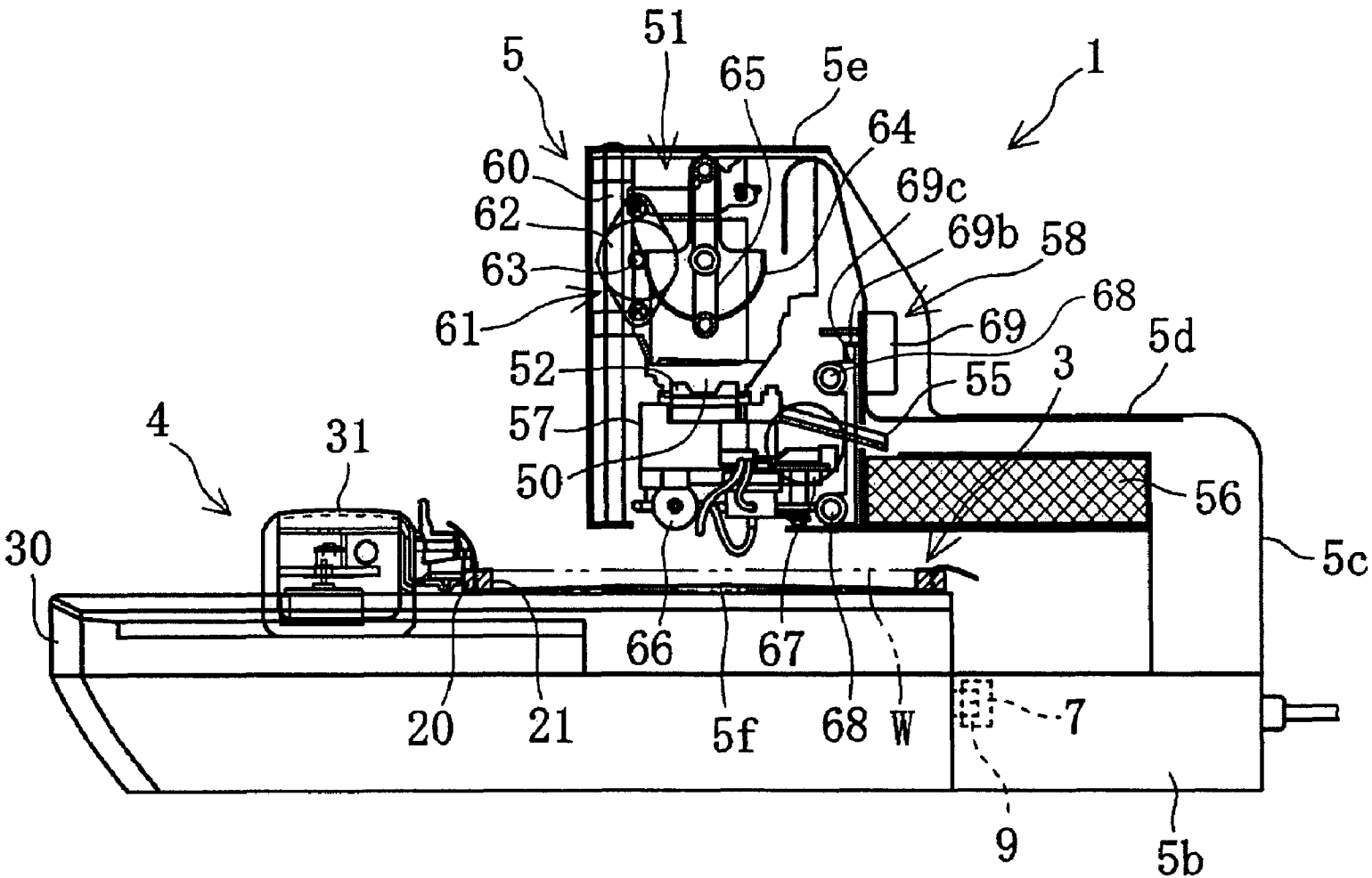
FIG. 6 is a front view of the frame drive unit and the printer as shown in FIG. 5.

On the other hand, the printer 5 is detachably attached to the mounting part 4*a* of the frame drive unit 4 separated from the sewing machine body 2. As shown in FIGS. 5 to 8, the electrical systems of the printer 5 and frame drive unit 4 as shown in FIG. 9 are connected together by the connectors 7 and 8 while the frame drive unit 4 is attached to the printer 5. When the printer 5 is not attached to the frame drive unit 4 as shown in FIGS. 3 and 4 or when the printer 5 is attached to the frame drive unit 4 but no print processing is carried out as shown in FIGS. 5 and 6, the print head 50 is located at the non-print position, the purging mechanism 53 (purge unit 57) is located at the purging position, and the nozzles of the print head 50 are covered by the head cap 52.

Also when the printer 5 is detached from the frame drive unit 4, the print head 50 is located at the non-print position, the purging mechanism 53 is located at the purging position and a relatively wider space is adapted to be defined between the bed 5*a* and the head 5*e*. Accordingly, the printer 5 can reliably be attached to and detached from the frame drive unit 4 without interference of the print head 50 and the like with the cloth holding frame 3 while the cloth holding frame 3 is coupled to the frame drive unit 4. When the printer 5 has been attached to the frame drive unit 4, the cloth positioning part 5*f* of the bed 5*a* is in contact with the workpiece cloth W held on the cloth holding frame 3 from below and at least part of the workpiece cloth W to be printed is stretched so that a suitable space is maintained between the workpiece cloth W and the print head 50.

When the print head 50 is to be flushed after having been wiped, the purging mechanism 53 is moved forward by the moving mechanism 58 thereby to be switched to the flushing position. In this case, the ink receiver 55 provided on the purge unit 57 is located below the nozzles of the print head 50 so that ink injected from the nozzles by the flushing is received by the ink receiver 55. The waste ink flows down along the ink receiver 55 thereby to be absorbed into the wasted ink absorbing felt 56. The purging mechanism 53 is switched to the printable position after the flushing has been carried out.

Figure 8:
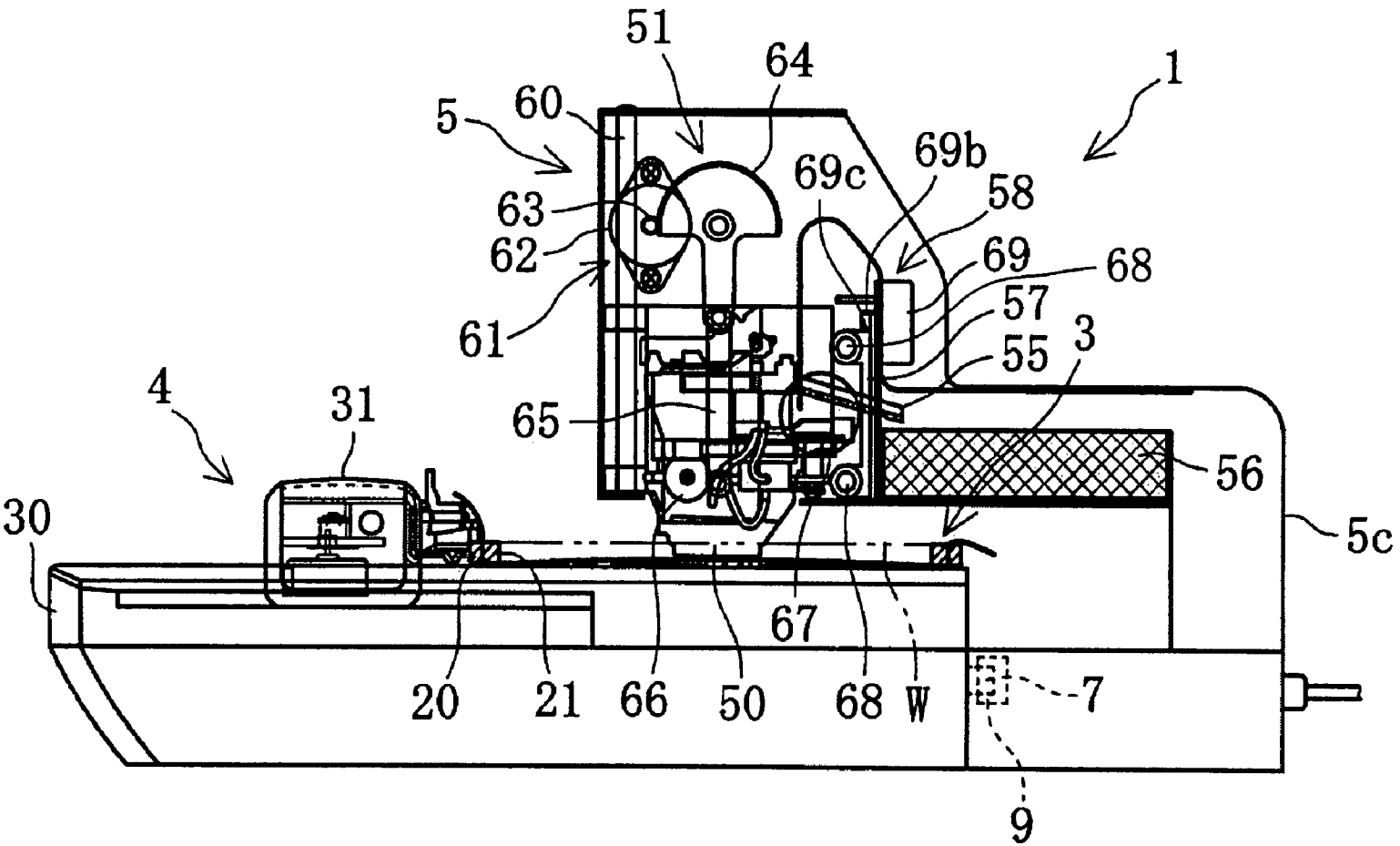
FIG. 8 is a front view of the frame drive unit and the printer as shown in FIG. 5.

Subsequently, the control unit 59 controls the head vertically moving motor 62 so that the print head 50 is lowered from the non-print position by the head position switching mechanism 51 thereby to be switched to the print position as shown in FIGS. 7 and 8. In this state, the control unit 59 of the printer 5 controls the frame driving motors 39 and 45 of the frame drive unit 4 based on the print data so that the cloth holding frame 3 coupled to the frame drive unit 4 is moved independently crosswise and horizontally. The print head 50 is driven by the control unit 59 so that the workpiece cloth W held on the cloth holding frame 3 and/or an embroidery pattern formed on the workpiece cloth W is printed.

Furthermore, when the print head 50 is flushed at suitable intervals during print processing, the print processing is interrupted and firstly, the print head 50 is moved upward to the non-print position by the head position switching mechanism 51 and the purging mechanism 53 is switched to the flushing position by the moving mechanism 58. The print head 50 is then lowered to the print position by the head position switching mechanism 51 and the print processing is restarted.

In the above-described printable embroidery machine 1, the frame drive unit 4 particularly has the mounting part 4*a* detachably attached to the sewing machine body 2. The printer 5 is detachably attached to the mounting part 4*a* of the frame drive unit 4. The workpiece cloth W held on the cloth holding frame 3 moved by the frame drive unit 4 can be printed by the printer 5. Accordingly, either frame drive unit 4 or printer 5 can be attached easily and reliably, whereupon both sewing and printing can be carried out for the workpiece cloth W without re-holding the workpiece cloth W on the cloth holding frame 3.

In the foregoing embodiment, moreover, the position of the sewing needle 11 in the case where the sewing machine body 2 is attached to the frame drive unit 4 can correspond approximately with the position of the print head 50 in the case where the printer 5 is attached to the frame drive unit 4, whereupon both sewing and printing can be carried our for the workpiece cloth W without offset of the cloth holding frame 3. Accordingly, the size of the frame drive unit 4 can be reduced and the manufacturing cost of the frame drive unit 4 can be lowered. Furthermore, since the workpiece cloth W held on the cloth holding frame 3 need not be detached from the cloth holding frame between the sewing and the printing or re-held on the cloth holding frame 3, accuracy can be improved in predetermined positions of an embroidery pattern and print pattern to be formed on the workpiece cloth W.

Furthermore, in the foregoing embodiment, the sewing needle 11 is located at the predetermined sewing reference position B1 when the sewing machine body 2 has been attached to the frame drive unit 4. The sewing reference position B1 corresponds with the predetermined print reference position B2 of the print head 50 in the case where the print head 5 has been attached to the frame drive unit 4. Accordingly, the sewing machine body 2 is attached to the frame drive unit 4 to form an embroidery pattern on the workpiece cloth W on the basis of the sewing reference position B1 whereas the printer 5 is attached to the frame drive unit 4 to form an embroidery pattern on the workpiece cloth W or the embroidery pattern formed on the workpiece cloth on the basis of the print reference position B2, whereby the embroidery pattern and the print pattern can reliably be formed on desired positions without displacement.

Furthermore, in the foregoing embodiment, the sewing reference position B1 is set so as to correspond with the center of the maximum moving region in the case where the sewing needle 11 is moved at a maximum by the frame drive unit 4. The print reference position B2 is set so that the center of the print head 50 corresponds with the center of the aforesaid maximum moving region. This can increase a sewable region of the workpiece cloth W to be sewn by the sewing machine body 2 and a printable region of the workpiece cloth W to be printed by the printer 5 while the size of the frame drive unit 4 is reduced.

On the other hand, in the embodiment, the connectors 7 and 8 connect the electrical systems of the frame drive unit 4 and sewing machine body 2 together. Of these connectors, the connector 8 has the same structure as the printer side connector 9 of the connectors 7 and 9 connecting the electrical systems of the frame drive unit 4 and the printer 5 together. Accordingly, the frame drive unit side connector 7 can be rendered connectable in common to the sewing machine body side connector 8 and the printer side connector 9, whereupon the connecting structure of the electrical systems between the frame drive unit 4, and the sewing machine body 2 and the printer 5 can be simplified such that the manufacturing cost can be suppressed.

Furthermore, in the embodiment, the printer 5 has the head position switching mechanism 51 switching the print head 50 between the print position where the print head 50 comes close to the workpiece cloth W and the non-print position spaced away from the print position. Accordingly, the print head 50 can reliably be switched to the print position such that the workpiece cloth W can be printed and reliably be switched to the non-print position so that the printer 5 can be attached to and detached from the frame drive unit 4.

Furthermore, in the embodiment, the printer 5 has the purging mechanism 53 purging the print head 50 and the moving mechanism 58 moving the purging mechanism 53 crosswise relative to the print head 50 thereby to be switchable between the purging position where the print head 50 is purged and the printable position which is spaced away from the purging position and where printing can be carried out. Accordingly, the purging mechanism 53 can reliably be switched to the purging position to purge the print head 50 so that dust and rubbish can reliably be removed.

Furthermore, in the embodiment, the nozzle wiper 54 of the print head 50 is provided in the purging mechanism 53. The print head 50 is wiped off by the nozzle wiper 54 when the purging mechanism 53 is moved from the purging position to the printable position by the moving mechanism 58. Consequently, the print head 50 can be wiped by the nozzle wiper 54 when the purging mechanism 53 is moved from the purging position to the printable position after the print head 50 has been purged, whereupon ink remaining on the surfaces of the nozzles of the print head 50 as the result of purging can reliably be cleaned.

Furthermore, in the embodiment, the ink receiver 55 is provided for receiving the ink due to the flushing of the print head 50. The moving mechanism 58 is configured to be capable of switching the purging mechanism 53 to the flushing position where the ink due to the flushing can be received by the ink receiver 55. Accordingly, the print head 50 can reliably be flushed such that the nozzles can reliably be prevented from being clogged. Furthermore, the head position switching mechanism 51 has the guide rod 60 guiding the print head 50 for vertical movement and the head vertically moving motor 62 vertically moving the print head 50. Consequently, the print head 50 can reliably be switchable between the print position and the non-print position.

Furthermore, in the embodiment, the printer 5 can perform color print by injecting a plurality of colors of inks. Accordingly, the printer 5 can form a color print pattern on the workpiece cloth W held on the cloth holding frame 3 moved by the frame drive unit 4 or an embroidery pattern formed on the workpiece cloth W. Furthermore, since the cartridge mounting part is provided integrally on the print head 50 of the printer 5 so that an ink cartridge can be attached thereto, the ink cartridge can be attached to the cartridge mounting part of the print head 50 so that the ink is supplied from the ink cartridge to the print head 50.

Next, a second embodiment of the present invention will be described with reference to FIGS. 10 to 17. The printable embroidery machine 1A includes the sewing machine body 2 which can sew the workpiece cloth W, the cloth holding frame 3 holding the workpiece cloth W to be sewn, the frame drive unit 4 which has the mounting part 4*a* detachably attached to the sewing machine body 2 and is coupled to the cloth holding frame 3 to move the cloth holding frame 3 independently both in cross and horizontal directions (in two horizontal directions perpendicular to each other), as shown in FIGS. 1 and 2. As shown in FIGS. 10 to 13, an ink-jet printer 5A is detachably attached to the mounting part 4*a* of the frame drive unit 4 separated from the sewing machine body 2 so that the workpiece cloth W held on the cloth holding frame 3 moved by the frame drive unit 4 can be printed by the printer 5A.

The sewing machine body 2, cloth holding frame 3 and frame moving unit 4 in the embroidery machine 1A have the same constructions as the sewing machine body 2, cloth holding frame 3 and frame moving unit 4 of the embroidery machine 1 of the first embodiment. Accordingly, the same reference symbols as in the first embodiment will be applied and the detailed description will be eliminated.

The printer 5A will be described. The printer 5A has a bed 5*g*, a pillar 5*h* standing from a right part of the bed 5*g* and an arm 5*i* extending leftward from an upper part of the pillar 5*h* so as to be opposite to the bed 5*g*. The mounting part 4*a* of the frame drive unit 4 is detachably attached to the bed 5*a*. The bed 5*a* has a convex cloth positioning part 5*j*.

The printer 5A comprises a print head 70, a head position switching mechanism 71, a head cap 72 covering the nozzles of the head print 70, a purging mechanism 73 purging the print head 70, a nozzle wiper 74 for the print head 70, and a wasted ink absorbing felt 75. The printer 5A is an apparatus capable of color print by injecting four colors of ink from the print head 70.

The aforesaid head position switching mechanism 71 has a function of switching the print head 70 between the print position (see FIGS. 12 and 13) where the print head 70 comes close to the workpiece cloth W held on the cloth holding frame 3 coupled to the frame drive unit 4 to which the printer 5A is attached and the non-print position (see FIG. 16) which is spaced away upward from the print position. The wasted ink absorbing felt 75 receives ink due to the flushing, absorbing the ink.

Furthermore, the head cap 72, nozzle wiper 74 and wasted ink absorbing felt 75 are provided in the purging mechanism 73. These members 72 to 75 are attached to the casing, thereby composing the purge unit 77. The purge unit 77 is provided in the pillar 5*h* and the print head 70 is provided in the arm 5*i*. The printer 5A includes a moving mechanism 78 which moves the print head 70 horizontally relative to the purging mechanism 73 (that is, the purge unit 77), thereby being capable of switching the print head 70 between the purging position (see FIG. 10) where the print head 70 can be purged and the printable position (see FIG. 12) which is spaced away leftward from the purging position so that printing is possible.

Figure 17:
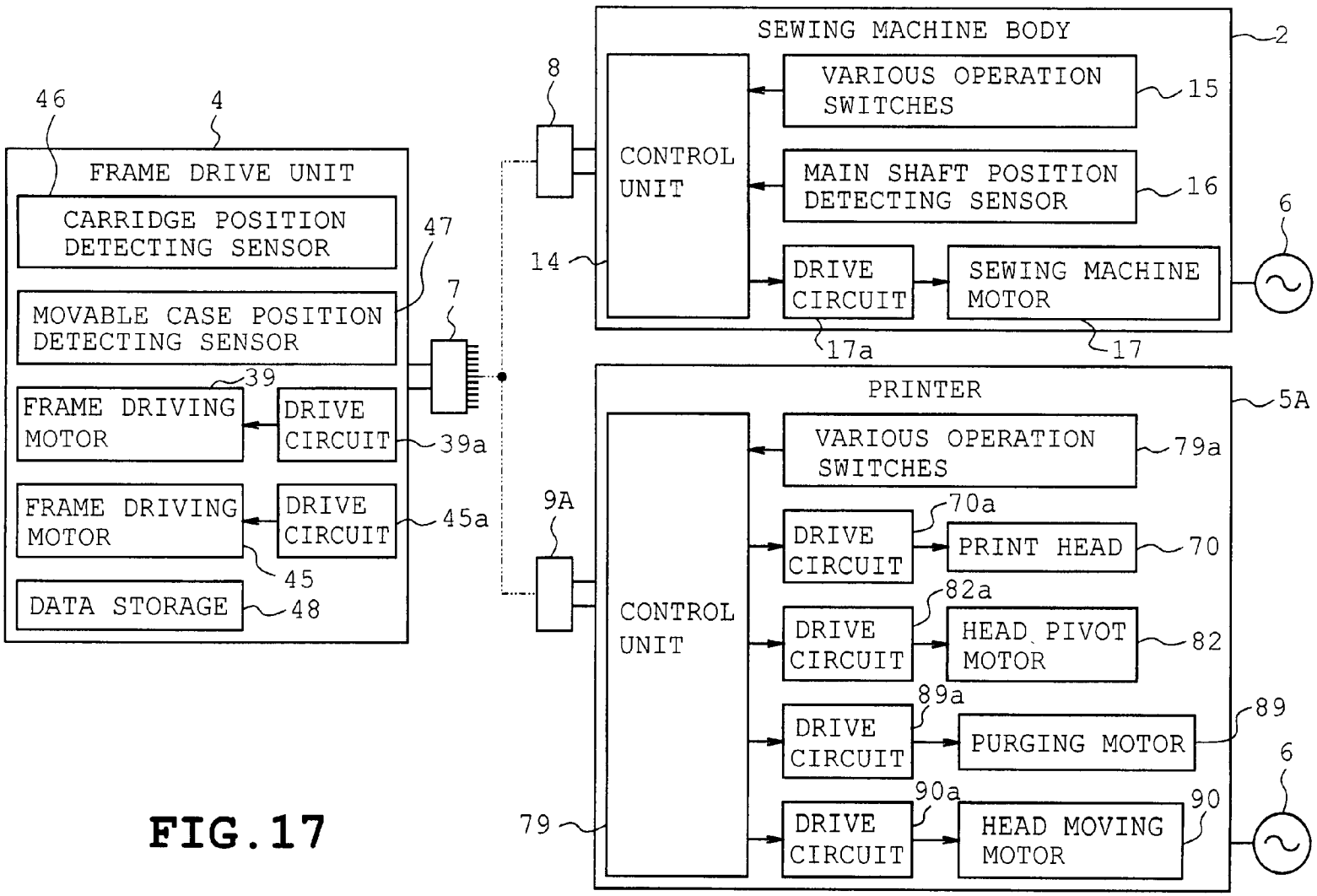
FIG. 17 is a block diagram of a control system of the frame drive unit, sewing machine body and printer.

Furthermore, as shown in FIG. 17, the printer 5A is provided with a control unit 79, various operation switches 79*a* and drive circuits 70*a*, 82*a* and 90*a* for the print head 70, head pivot motor 82, purging motor 89 and head moving motor 90 respectively. Electric power is supplied from a domestic power supply 6 to the printer 5A. A frame drive unit side connector member 7 and a printer side connector 9A are provided for connecting the electrical systems of the frame drive unit 4 and the printer 5A together. The frame drive unit side connector member 7 and a printer side connector 9A are automatically connected and disconnected by attaching and detaching the printer 5A to and from the frame drive unit 4.

In this case, when the frame drive unit side connector member 7 and a printer side connector member 9A are connected together, the control unit 79 of the printer 5A is connected to the sensors 46 and 47 of the frame drive unit 4, the drive circuits 39*a* and 45*a* and the data storage 48 so that electric power is supplied from the domestic power supply 6 via the printer 5A to the frame drive unit 4, whereupon the frame driving motors 39 and 45 are controlled by the control unit 79. Thus, the sewing machine body side and printer side connectors 8 and 9A are constructed into the same structure. Since each of the print head 70 and the cartridge provided at an upper part of the print head 70 has the same construction as that in the first embodiment, the description thereof will be eliminated.

Furthermore, the head position switching mechanism 71 has a guide shaft 80 pivotally supporting the print head 70 and the moving mechanism 78 integrally about a horizontal axis and a head rotating mechanism 81 including an electrically driven head pivot motor 82 rotating the print head 70. The head rotating mechanism 81 crosswise moves the purge unit 77 supported by a pair of right and left guide rods 77*a* to rotate the print head 70 so that the print head 70 is switched between the print position and the non-print position.

Figure 14:
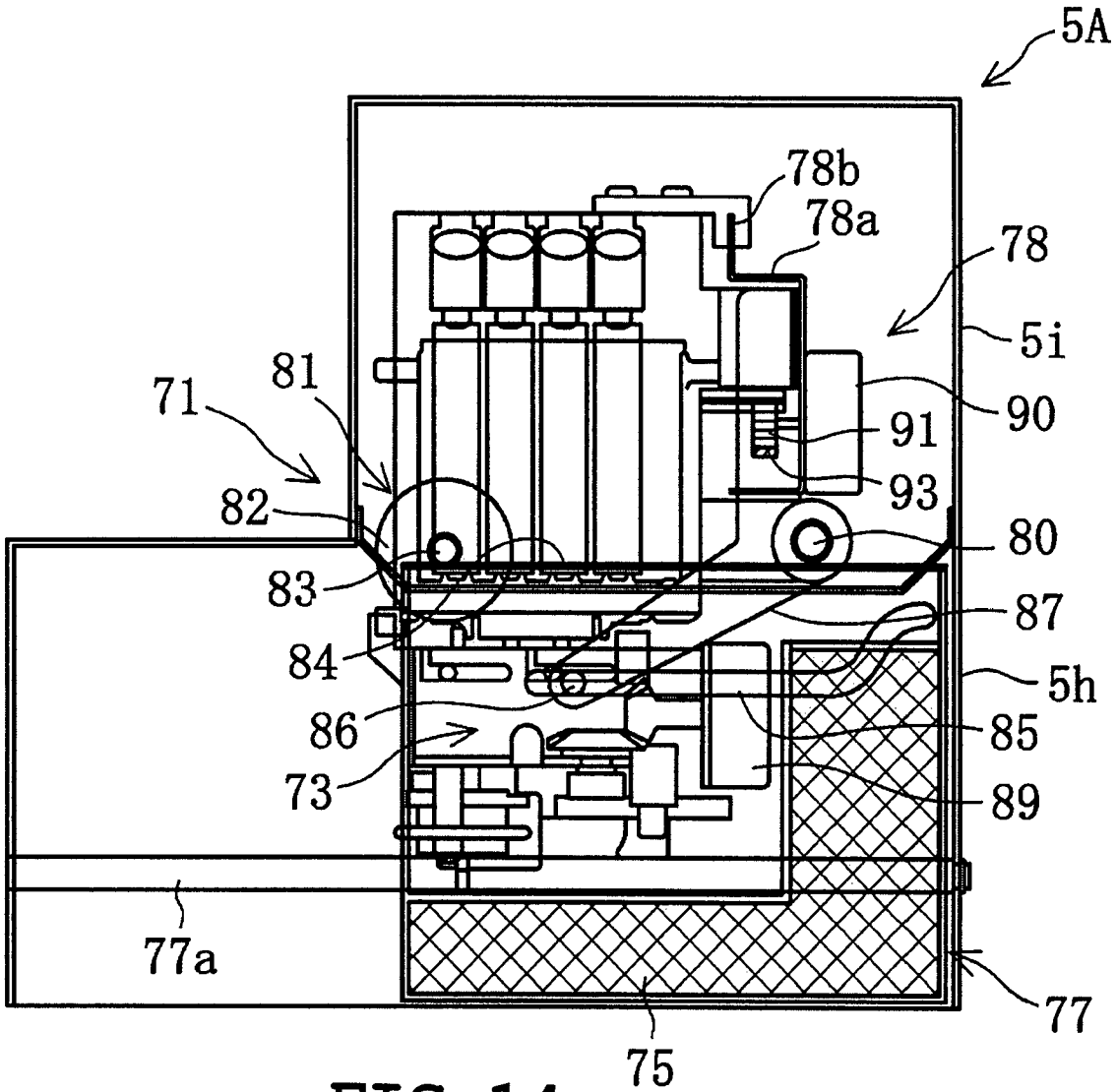
FIG. 14 is a longitudinal section of the major part of the printer (purgeable state)
Figure 15:
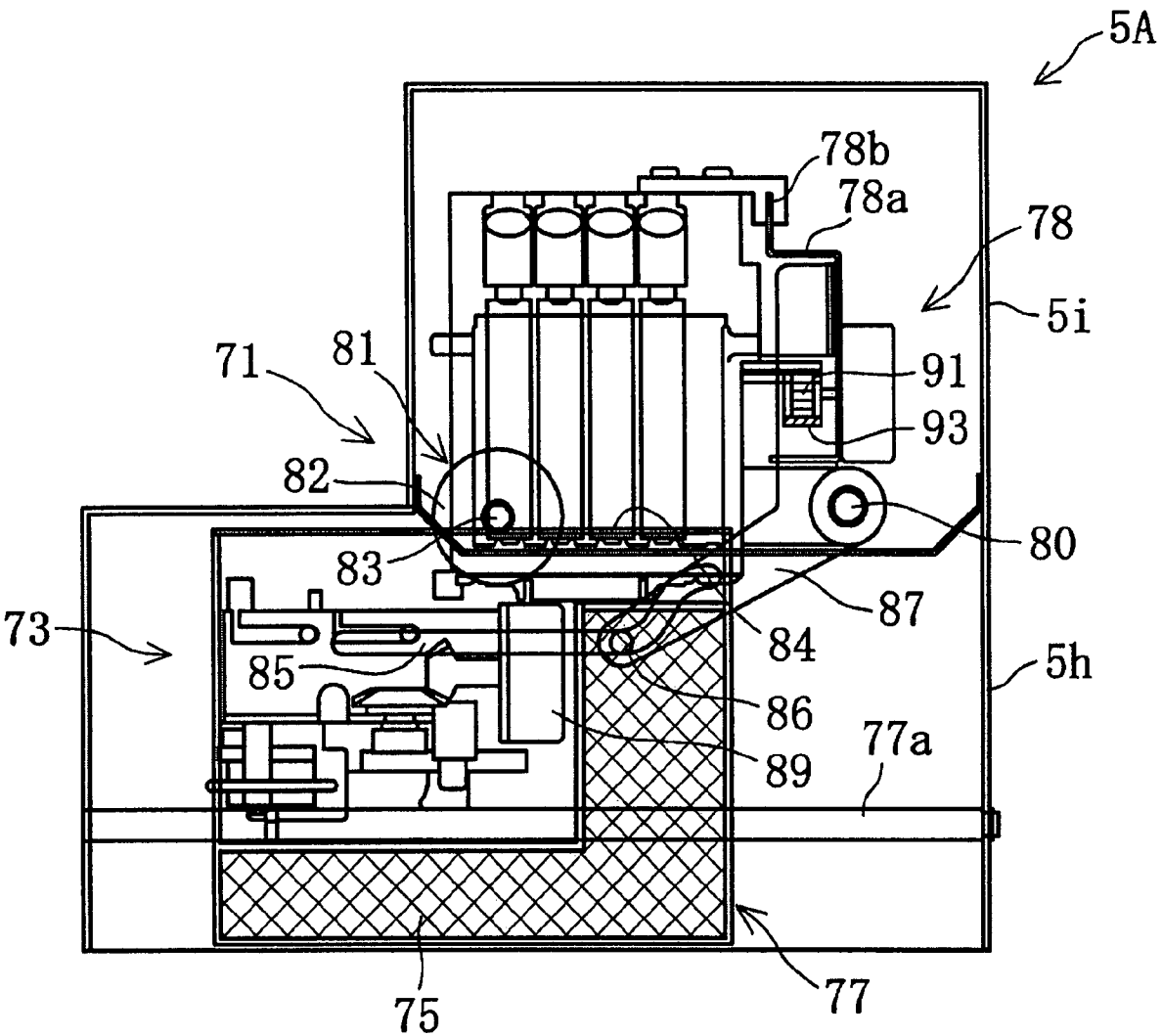
FIG. 15 is a longitudinal section of the major part of the printer (printable state)

Furthermore, the head rotating mechanism 81 has a head pivot motor 82, a rack 84 provided on an upper surface of the case of the purge unit 77 and brought into mesh engagement with a driving pinion 83 of the head pivot motor 82, an engagement groove 85 formed in a side plate of the case of the purge unit 77 and an arm 87 pivotally supported on the guide shaft 80 and having one end on which a follower 86 engaging the engagement groove 85 and the other end coupled to a frame 78*a*. In this construction, when the purge unit 77 is located between a first position as shown in FIG. 14 and a second position as shown in FIG. 15, the follower 86 engages a horizontal groove part of the engagement groove 85 so that the print head 70 is held in a vertically downward position. The print head 70 assumes the print position when located at the left end of the arm 5*i*, protruding below the arm 5*i* to come close to the workpiece cloth W held on the cloth holding frame 3.

Furthermore, when the purge unit 77 is located in front of the second position shown in FIG. 15, the follower 86 engages a cam groove of the engagement groove 85 such that the purge unit 77 is moved crosswise. Then, the follower 86 follows the cam groove of the engagement groove 85 so that the print head 70 pivots together with the arm 87, whereupon the purge unit 77 assumes the third position shown in FIG. 16. The print head 70 is then inclined about 15 degrees from the vertically downward position thereby to be located at the non-print position. As a result, the print head 70 is located in the above a bottom plate of the arm 5*i* and is allowed to move horizontally in the arm 5*i*.

Figure 10:
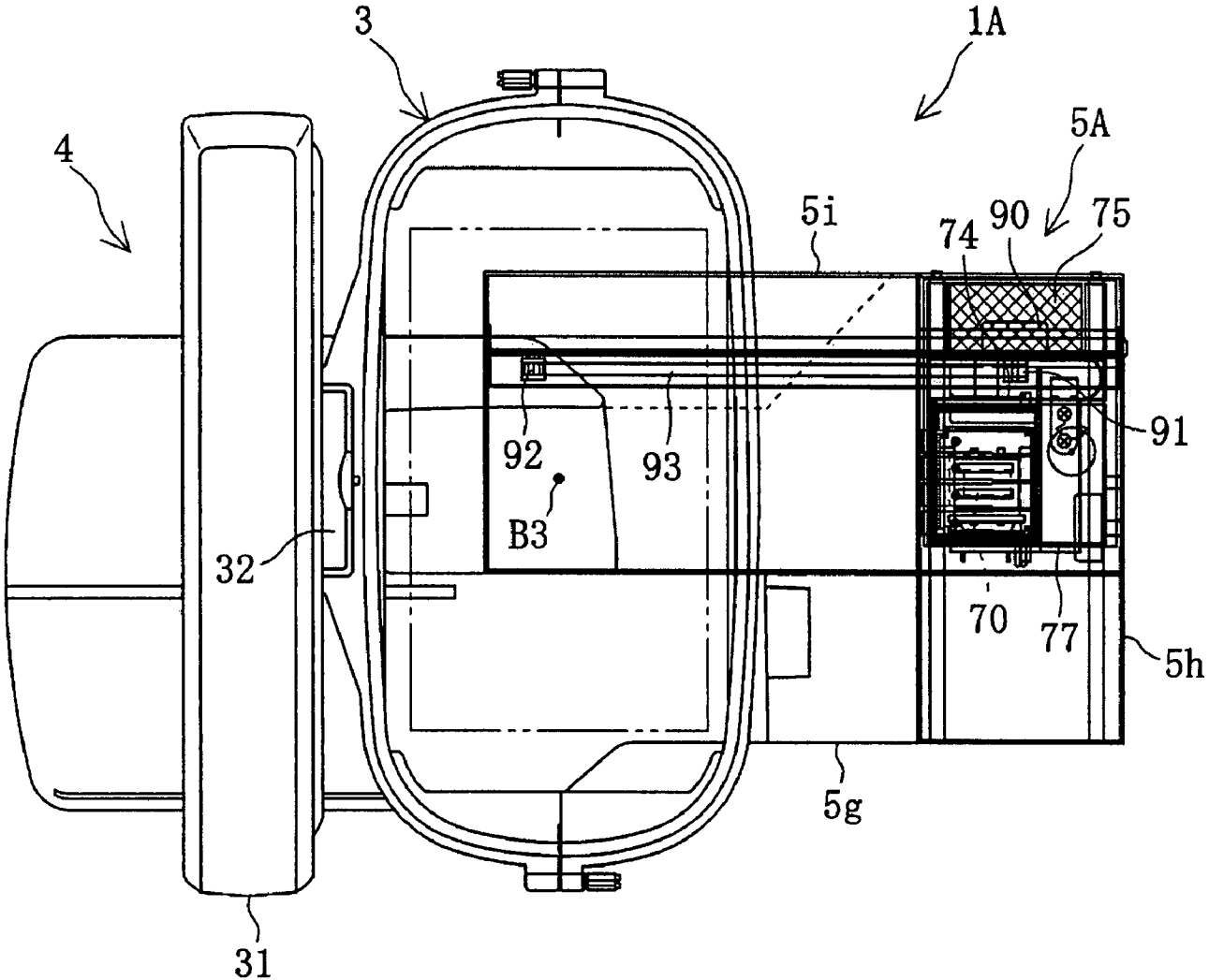
FIG. 10 is a plan view of the embroidery machine (the sewing machine body and the frame drive unit)
Figure 11:
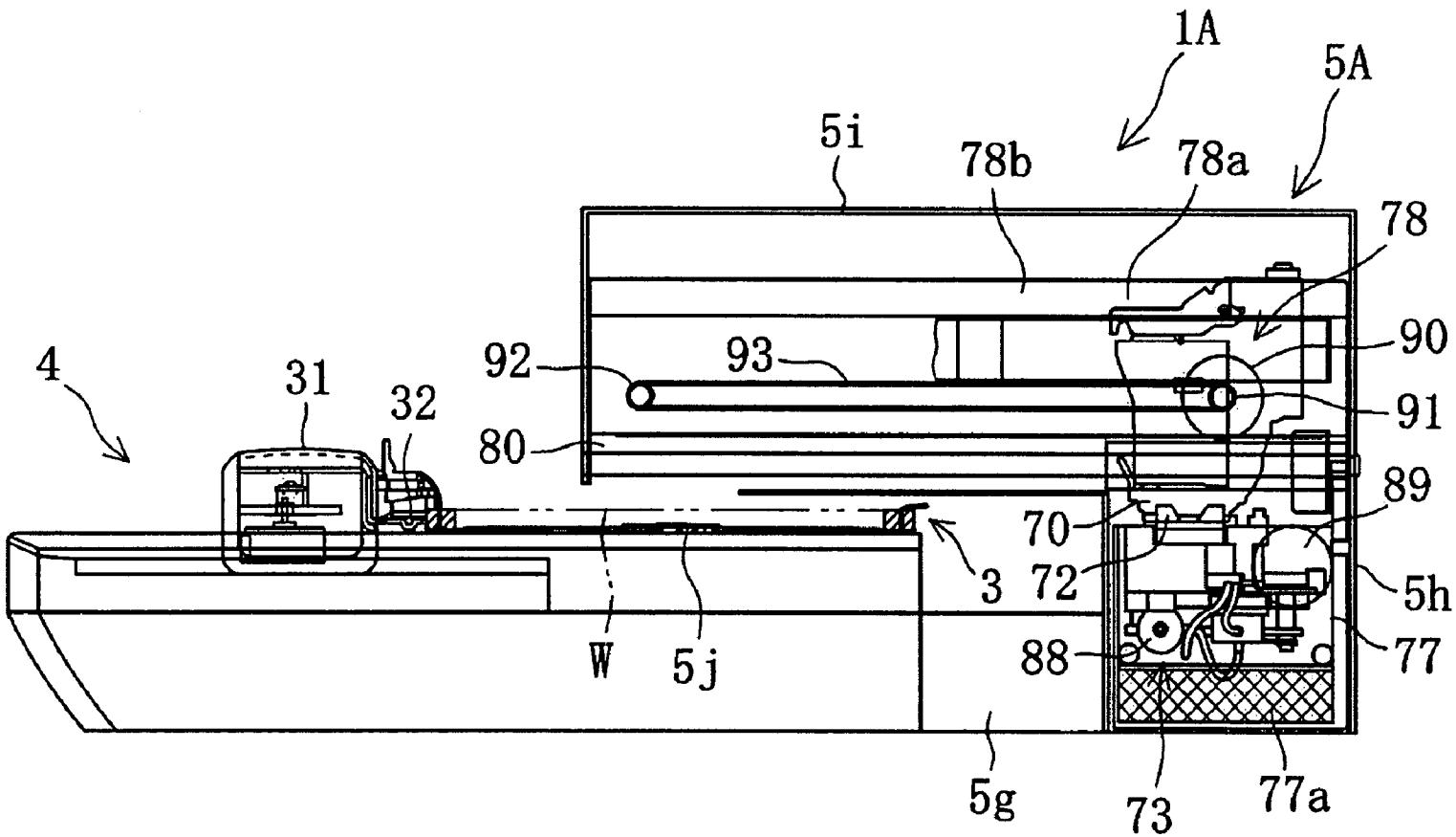
FIG. 11 is a front view of the embroidery machine as shown in FIG. 10.

The head cap 72 basically have the same construction as the head cap 52 in the first embodiment and the purging mechanism 73 also has the same construction as the purging mechanism 53. The purging mechanism 73 has a suction pump 88, and a purging motor 89. The head cap 72 is constructed so as to cover the nozzles of the print head 70 and the purging mechanism 73 is constructed so as to be able to purge the print head 70 when the purging unit 77 is located at the first position shown in FIG. 14 and the print head 70 is located at the purging position in the vertically downward state as shown in FIGS. 10 and 11.

Furthermore, the nozzle wiper 74 is located in the rear of the head cap 72 of the purge unit 77 and in front of the nozzles of the print head 70 assuming the purging position when the purge unit 77 is located at the second position shown in FIG. 15. The nozzle wiper 74 is further provided at the level of the nozzles of the print head 70. The print head 70 is brought into contact with the nozzle wiper 74 thereby to be wiped when the purge unit 77 is moved from the first position to the second position after the purging mechanism 73 has purged the print head 70, whereupon ink remaining on the surfaces of the nozzles of the print head 70 is cleaned by the purging.

The flushing position is reached when the purge unit 77 is located at the third position shown in FIG. 16 and the print head 70 assumes the purging position, whereupon the upper side of the wasted ink absorbing felt 75 is located below the nozzles of the print head 70. When the print head 70 is flushed, the wasted ink is injected directly onto the wasted ink absorbing felt 75 thereby to be absorbed thereinto.

On the other hand, in the head 5*i* are provided a guide shaft 80 directed horizontally over a horizontal dimension thereof and a frame 78*a* supported on the guide shaft 80. The frame 78*a* has an upper end formed integrally with a guide rail 78, and the print head 70 is supported by the guide shaft 80 and the guide rail 78*b* so as to be guided. More specifically, when the frame 78*a* is caused to pivot by the head rotating mechanism 81, the print head 70 engaged by the guide rail 78*b* and the guide shaft 80 together with the frame 78*a* pivots while the aforesaid engagement is maintained.

The moving mechanism 78 has an electrically driven head moving motor 90 provided in the arm 5*i* and driving the print head 70 horizontally. The head moving motor 90 is fixed to a right end of the frame 78 and has an output shaft to which a pinion 91 is secured. A pinion 92 is supported on a left end of the frame 78*a*. An endless belt 93 extends between the pinions 91 and 92. The print head 70 is coupled to the belt 93. Accordingly, the print head 70 can be driven horizontally irrespective of the rotational position of the print head 70.

Figure 12:
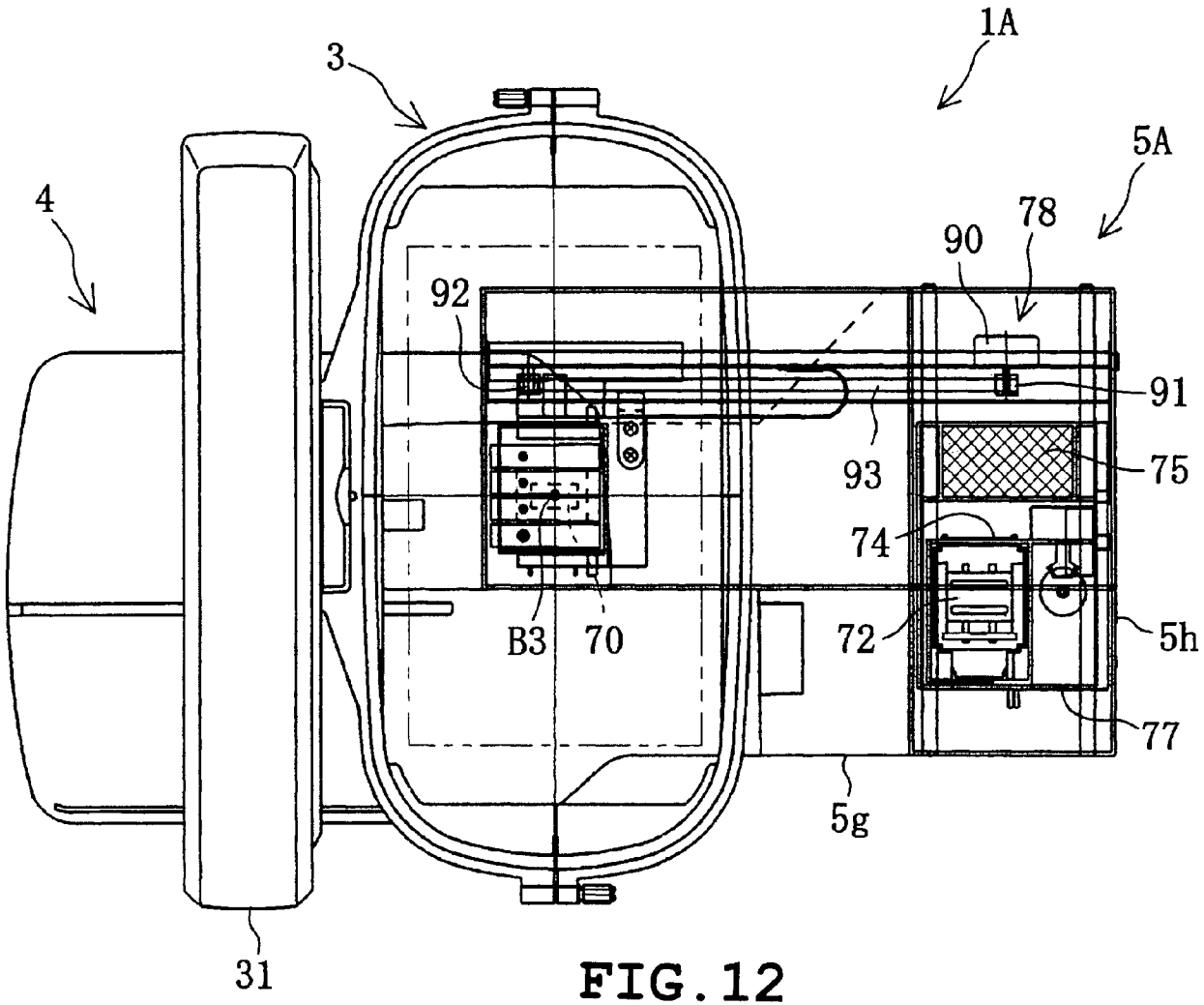
FIG. 12 is a plan view of the frame drive unit and the printer (printable state) coupled together.
Figure 13:
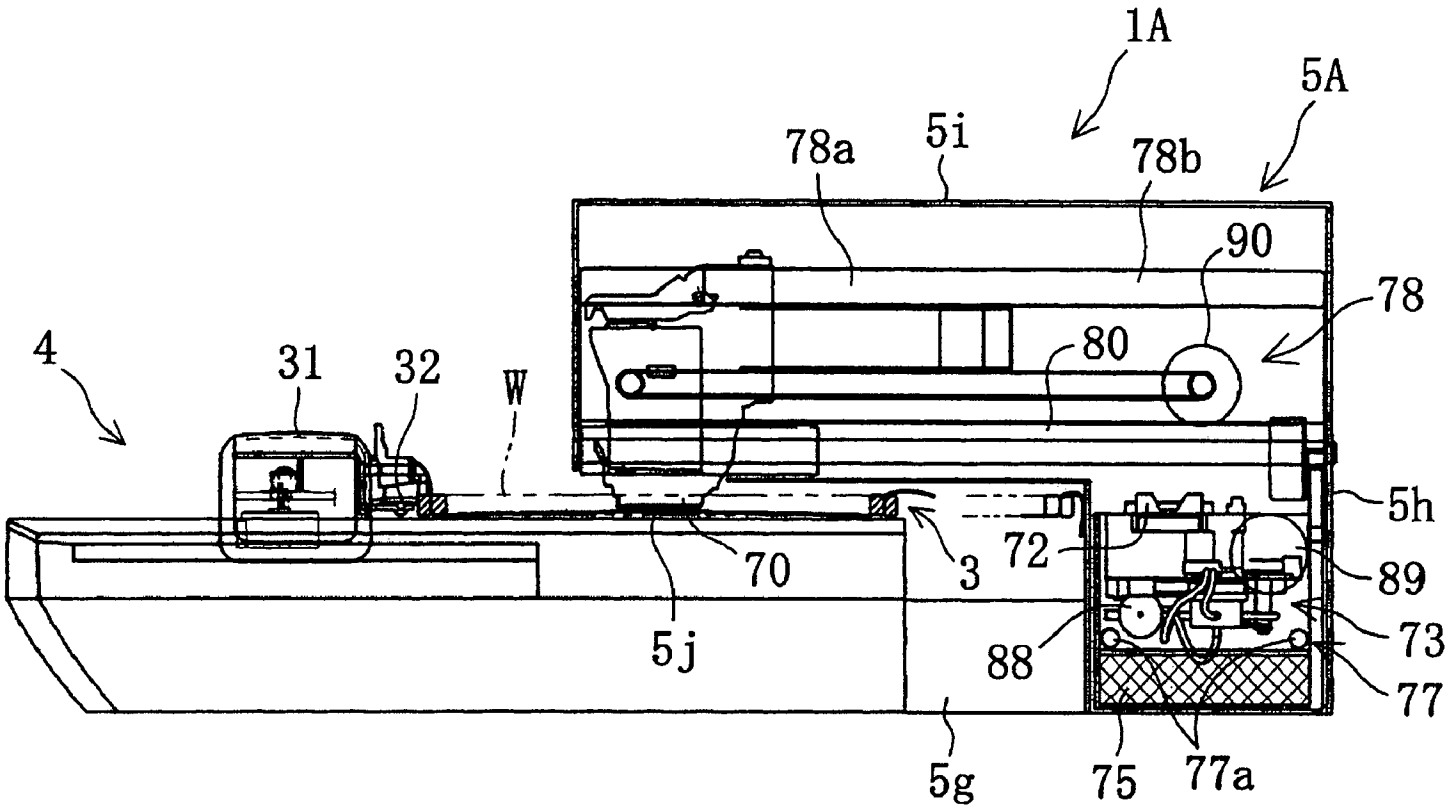
FIG. 13 is a front view of the frame drive unit and the printer as shown in FIG. 12.

FIG. 1 shows the predetermined sewing reference position B1 of the sewing needle 11 in the case where the sewing machine body 2 is attached to the frame drive unit 4 as shown in FIG. 1 in the printable embroidery machine. FIGS. 10 and 12 show the predetermined print reference position B3 of the print head 70 in the case where the printer 5A is attached to the frame drive unit 4. The embroidery machine is constructed so that the reference positions B1 and B3 correspond to each other. The sewing reference position B1 is set so that the sewing needle 11 assumes a position corresponding to the center of the maximum moving region in the case where the cloth holding frame 3 is moved at a maximum by the frame drive unit 4. Furthermore, the print reference position B3 is set at a position where the center of the print head 70 corresponds to the center of the aforesaid maximum moving region. The center of the print head 70 refers to the center of each of a plurality of nozzles of the print head 70.

The operation and effects of the printable embroidery machine will now be described. However, the description of operation and effects which are basically the same as those of the first embodiment will be eliminated.

The printer 5A is detachably attached to the mounting part 4*a* of the frame drive unit 4 separated from the sewing machine body 2. As shown in FIGS. 10 to 13, the electrical systems of the printer 5A and the frame drive unit 4 are connected together by the connectors 7 and 9A while the printer 5A is attached to the frame drive unit 4 as shown in FIG. 17. When the printer 5A is not attached to the frame drive unit 4 or when the printer 5A is attached to the frame drive unit 4 but no print processing is carried out as shown in FIGS. 10 and 11, the print head 70 is located at the purging position, the purging unit 77 is located at the first position shown in FIG. 14, and the nozzles of the print head 70 are covered by the head cap 72.

Furthermore, when the printer 5A is detached from the frame drive unit 4, the print head 70 is located at the purging position and a relatively larger space is defined between the bed 5*a* and the distal end of the arm 5*i*. Accordingly, the printer 5A can reliably be attached to and detached from the frame drive unit 4 without interference of the print head 70 and the like with the cloth holding frame 3 under the condition where the cloth holding frame 3 is coupled to the frame drive unit 4. Furthermore, when the printer 5 is attached to the frame drive unit 4, the cloth positioning part 5*j* of the bed 5*g* is brought into contact with the workpiece cloth W held on the cloth holding frame 3 from below such that at least a part of the workpiece cloth W to be printed is reliably be stretched.

When the print processing is executed while the printer 5A is attached to the frame drive unit 4, the control unit 79 controls the purging motor 89 under the condition as shown in FIGS. 10 and 11 so that the print head 70 is purged by the purging mechanism 73. Subsequently, the control unit 79 controls the head pivot motor 82 so that the purge unit 77 is moved forward from the first position by the control unit 79 thereby to be switched to the second position as shown in FIG. 15. In this while, the nozzles of the print head 70 are wiped by the nozzle wiper 74 provided in the purge unit 77.

Figure 16:
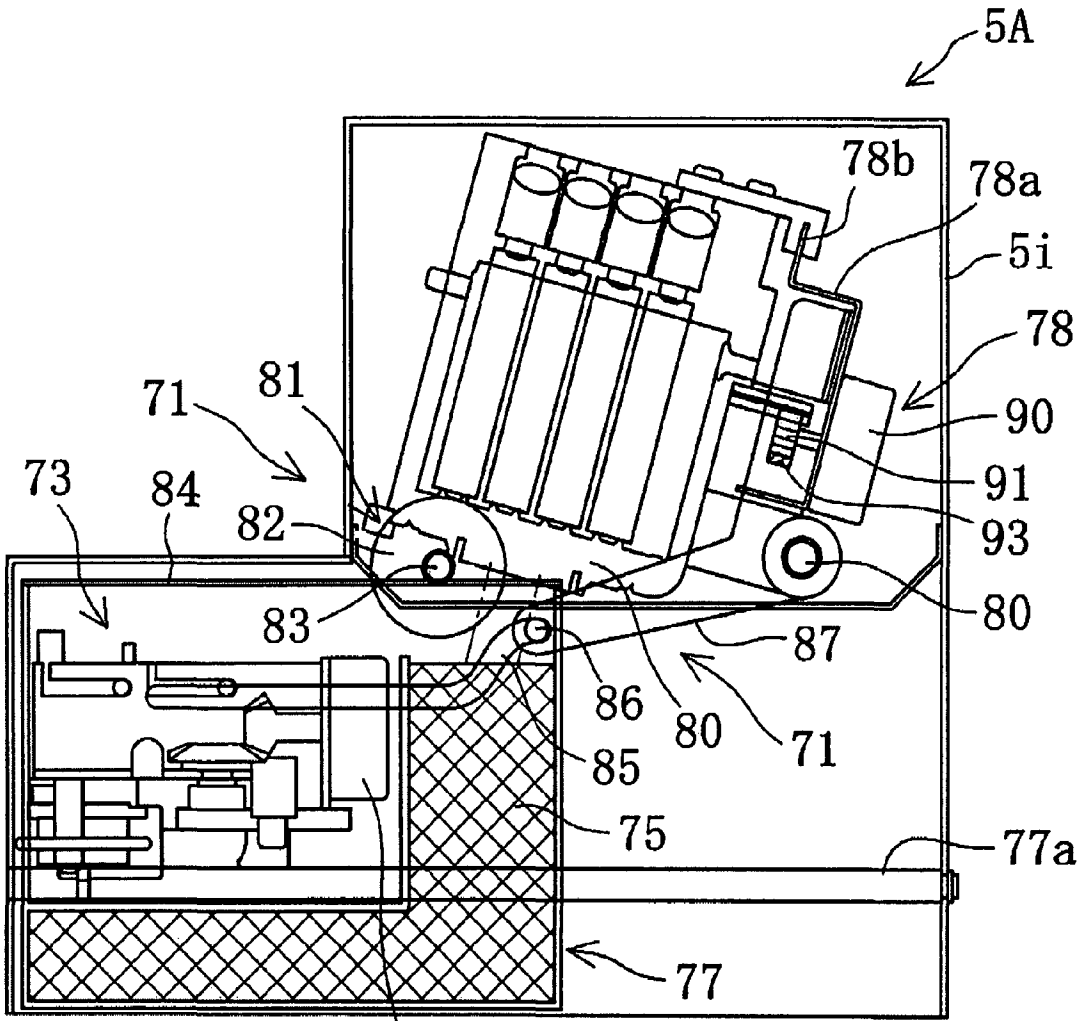
FIG. 16 is a longitudinal section of the major part of the printer (flushable state)

Subsequently, as shown in FIG. 16, when the purge unit 77 is switched by the head rotating mechanism 81 so as to be moved forward from the second position to the third position, the print head 70 is caused to pivot thereby to assume a position above the bottom plate of the arm 5*i*. In this case, the wasted ink absorbing felt 75 is located below the nozzles of the print head 70 and ink is injected directly from the nozzles to the wasted ink absorbing felt 75 when the flushing is carried out.

Next, the control unit 79 controls the head moving motor 90 so that the print head 70 is moved by the moving mechanism 78 leftward thereby to be switched to the printable position. The head pivot motor 82 is then controlled so that the purge unit 77 is moved rearward from the third position to the second position. As a result, the print head 50 assumes the vertically downward position and is switched to the print position. In this state, the control unit 79 of the printer 5A controls the frame driving motors 39 and 45 of the frame drive unit 4 so that the cloth holding frame 3 coupled to the frame drive unit 4 is moved independently crosswise and horizontally and the control unit 79 drives the print head 70 so that the workpiece cloth W held on the cloth holding frame 3 or an embroidery pattern formed on the workpiece cloth W is printed.

Furthermore, when the print head 70 is to be flushed at intervals of predetermined time during print processing, the print processing is interrupted and the print head 70 is switched to the non-print position by the head position switching mechanism 71. Successively, the print head 70 is switched to the flushing position by the moving mechanism 78. Subsequently, the print had 70 is returned to the print position by the reverse operation, the print processing is restarted.

The printable embroidery machine of the present invention may be modified into various forms without departing from the gist thereof.

INDUSTRIAL APPLICABILITY

As described above, the printable embroidery machine of the present invention is suitable for an embroidery machine used at home and useful as a printable embroidery machine having the construction of a household embroidery machine provided with a printing function.

The invention claimed is:

1. A printable embroidery machine comprising:

a sewing machine body that sews a workpiece cloth, a cloth holding frame holding workpiece cloth to be sewn, a frame drive unit which has a mounting part and to which the cloth holding frame is coupled so that the cloth holding frame is moved independently in two horizontal directions perpendicular to each other, and an ink-jet printer, wherein the sewing machine body and the ink-jet printer are detachably attachable to the mounting part of the frame drive unit so that the workpiece cloth held on the cloth holding frame moved by the frame drive unit is printed by the printer when the printer is attached to the mounting part, whereby the mounting part is commonly attachable to the sewing machine body and the ink-jet printer, and a predetermined sewing reference position of a sewing needle in attaching the sewing machine body to the frame drive unit corresponds with a predetermined print reference position of a print head of the printer in a case where the printer is attached to the frame drive unit.

2. The printable embroidery machine of claim 1, wherein the sewing reference position is set at a position where the sewing needle corresponds with a center of a maximum moving region obtained when the cloth holding frame is moved maximally by the frame drive unit, and the print reference position is set at a position where a center of the print head corresponds with the center of the maximum moving region.

3. The printable embroidery machine of claim 1, wherein a connector electrically connecting the frame drive unit and the sewing machine body to each other includes a frame drive unit side connector member which is structured to be also connectable to a printer side connector member electrically connecting the frame drive unit and the printer to each other.

4. The printable embroidery machine of claim 1, wherein the printer has a head position switching mechanism switching the printer head between a print position where the print head is located close to the workpiece cloth held on the cloth holding frame coupled to the frame drive unit to which the printer is attached and a non-print position where the print head is spaced away from the print position.

5. The printable embroidery machine of claim 4, wherein the head position switching mechanism has a head guide which guides the print head so that the print head is movable upward or downward and an electric motor which drives the print head so that the print head is moved upward or downward.

6. The printable embroidery machine of claim 4, wherein the head position switching mechanism has a head support which pivotally supports the print head about a horizontal axis and an electric motor which drives the print head so that the print head is caused to pivot.

7. The printable embroidery machine of claim 1, wherein the printer has a purging mechanism purging the print head and a moving mechanism moving the purging mechanism and the print head horizontally relative to each other so that the purging mechanism or the print head is switchable between a purging position where purging is allowed and a printable position which is spaced away from the purging position and where printing is allowed.

8. The printable embroidery machine of claim 7, wherein the purging mechanism is provided with a nozzle wiper for the print head, and the print head is wiped by the nozzle wiper when the purging mechanism or the print head is moved by the moving mechanism from the purging position to the printable position.

9. The printable embroidery machine of claim 8, wherein the purging mechanism is provided with an ink receiver which receives ink resulting from the flushing of the print head, and the moving mechanism is capable of moving the purging mechanism or the print head to a flushing position where the ink receiver is capable of receiving the ink resulting from the flushing of the print head.

10. The printable embroidery machine of claim 7, wherein the moving mechanism moves the purging mechanism horizontally.

11. The printable embroidery machine of claim 7, wherein the moving mechanism moves the print head horizontally.

12. The printable embroidery machine of claim 1, wherein the printer is capable of injecting a plurality of colors of ink from the print head, thereby performing color print.

13. The printable embroidery machine of claim 1, wherein the print head of the printer is provided integrally with a cartridge attaching part to which an ink cartridge is attachable.

14. A frame drive unit which has a mounting part which is attachable to a sewing machine body that sews a workpiece cloth and to which a cloth holding frame holding the workpiece cloth to be sewn is coupled so that the cloth holding frame is moved independently in two horizontal directions perpendicular to each other, the sewing machine body and an ink-jet printer are detachably attachable to the mounting part, wherein the workpiece cloth held on the cloth holding frame moved by the frame drive unit is capable of being printed by the printer when the printer is attached to the mounting part, wherein the sewing machine body and the ink-jet printer are detachably attachable to the mounting part of the frame drive unit so that the workpiece cloth held on the cloth holding frame moved by the frame drive unit is printed by the printer when the printer is attached to the mounting part, whereby the mounting part is commonly attachable to the sewing machine body and the ink-jet printer, and wherein a predetermined sewing reference position of a sewing needle in attaching the sewing machine body to the frame drive unit corresponds with a predetermined print reference position of a print head of the printer in a case where the printer is attached to the frame drive unit.

* * * * *